US011820620B2

(12) United States Patent
Miyazawa et al.

(10) Patent No.: US 11,820,620 B2
(45) Date of Patent: Nov. 21, 2023

(54) ATTACHMENT UNIT AND IMAGE FORMING SYSTEM

(71) Applicant: SEIKO EPSON CORPORATION, Tokyo (JP)

(72) Inventors: Masaki Miyazawa, Matsumoto (JP); Hirohisa Adachi, Matsukawa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/814,263

(22) Filed: Jul. 22, 2022

(65) Prior Publication Data

US 2023/0028320 A1 Jan. 26, 2023

(30) Foreign Application Priority Data

Jul. 26, 2021 (JP) ..... 2021-121306

(51) Int. Cl.
*B65H 31/22* (2006.01)
*B65H 31/10* (2006.01)

(52) U.S. Cl.
CPC ..... *B65H 31/10* (2013.01); *B65H 31/22* (2013.01)

(58) Field of Classification Search
CPC ..... B65H 31/22; B65H 2405/353
USPC ..... 270/58.13, 58.28
See application file for complete search history.

(56) References Cited

U.S. PATENT DOCUMENTS 5,098,074 A * 3/1992 Mandel ..... B65H 31/10 270/58.13
5,374,043 A * 12/1994 Mandel ..... B42C 1/125 270/58.14
5,992,838 A * 11/1999 Saitoh ..... B42C 1/125 270/58.28
7,883,079 B2 * 2/2011 Sato ..... B65H 45/18 270/32
8,332,065 B2 * 12/2012 Kurakata ..... G03G 15/6573 270/58.12
8,678,368 B2 * 3/2014 Yoshida ..... B65H 31/02 270/58.11
8,985,582 B2 * 3/2015 Igarashi ..... B65H 31/22 271/298
2011/0052361 A1 * 3/2011 Iguchi ..... B65H 29/46 414/794.9
2019/0273833 A1 * 9/2019 Sato ..... G03G 21/1633
2020/0142343 A1 5/2020 Uegane et al.

FOREIGN PATENT DOCUMENTS

JP 2008-137742 A 6/2008
JP 2019-115988 A 7/2019
JP 2020-070170 A 5/2020

* cited by examiner

*Primary Examiner* — Leslie A Nicholson, III
(74) *Attorney, Agent, or Firm* — WORKMAN NYDEGGER

(57) ABSTRACT

A post-processing unit is disposed so as to face the apparatus side surface of a printer that has a manual feed tray protruding from the apparatus side surface. The post-processing unit has an ejection tray, which is movably provided in a unit body and to which paper accepted from the printer is ejected. In an apparatus height direction crossing a direction in which paper is ejected, the ejection tray can be moved to a first position at which ejected paper can be mounted and to a second position at which part of paper mounted on the manual feed tray can be supported.

17 Claims, 14 Drawing Sheets

ATTACHMENT UNIT AND IMAGE FORMING SYSTEM

The present application is based on, and claims priority from JP Application Serial Number 2021-121306, filed Jul. 26, 2021, the disclosure of which is hereby incorporated by reference herein in its entirety.

BACKGROUND

1. Technical Field

The present disclosure relates to an attachment unit and an image forming system.

2. Related Art

In an image forming system described in JP-A-2019-115988, the upper surface of a relay transport unit and the upper surface of a post-processing unit constitute a sheet end support portion disposed above the height position of an end of an original ejection tray. When a long sheet is ejected to the original ejection tray of an image reading unit, an end of the long sheet is supported by the sheet end support portion.

In an image forming apparatus described in JP-A-2008-137742, a surface on which to mount the rear end of paper mounted on a manual feeding tray is a manually-fed paper stacking surface of the upper portion of a side paper deck portion attached to the outside of the image forming apparatus.

When the structure described in JP-A-2019-115988 or JP-A-2008-137742 is used to support a long medium, there must be a match between the height of a tray in a recording apparatus and the height of the upper surface of an attachment unit facing a side surface of the recording apparatus. In addition, the upper surface of the attachment unit needs to be shaped so that part of the long medium can be mounted on the upper surface. Therefore, the attachment unit needs to be designed so as to conform to the structure of the recording apparatus. This may lower flexibility in the design of the attachment unit.

SUMMARY

To solve the above problem, an attachment unit according to the present disclosure is disposed so as to face the apparatus side surface of a recording apparatus that has a medium mounting tray protruding from the apparatus side surface. The attachment unit has an ejection tray disposed, which is movably provided in a unit body and to which a medium accepted from the recording apparatus is ejected. In an apparatus height direction crossing a direction in which the medium is ejected, the ejection tray can move to a first position at which the medium that has been ejected can be mounted and to a second position at which part of the medium mounted on the medium mounting tray can be supported.

DESCRIPTION OF EXEMPLARY EMBODIMENTS

Figure 1:
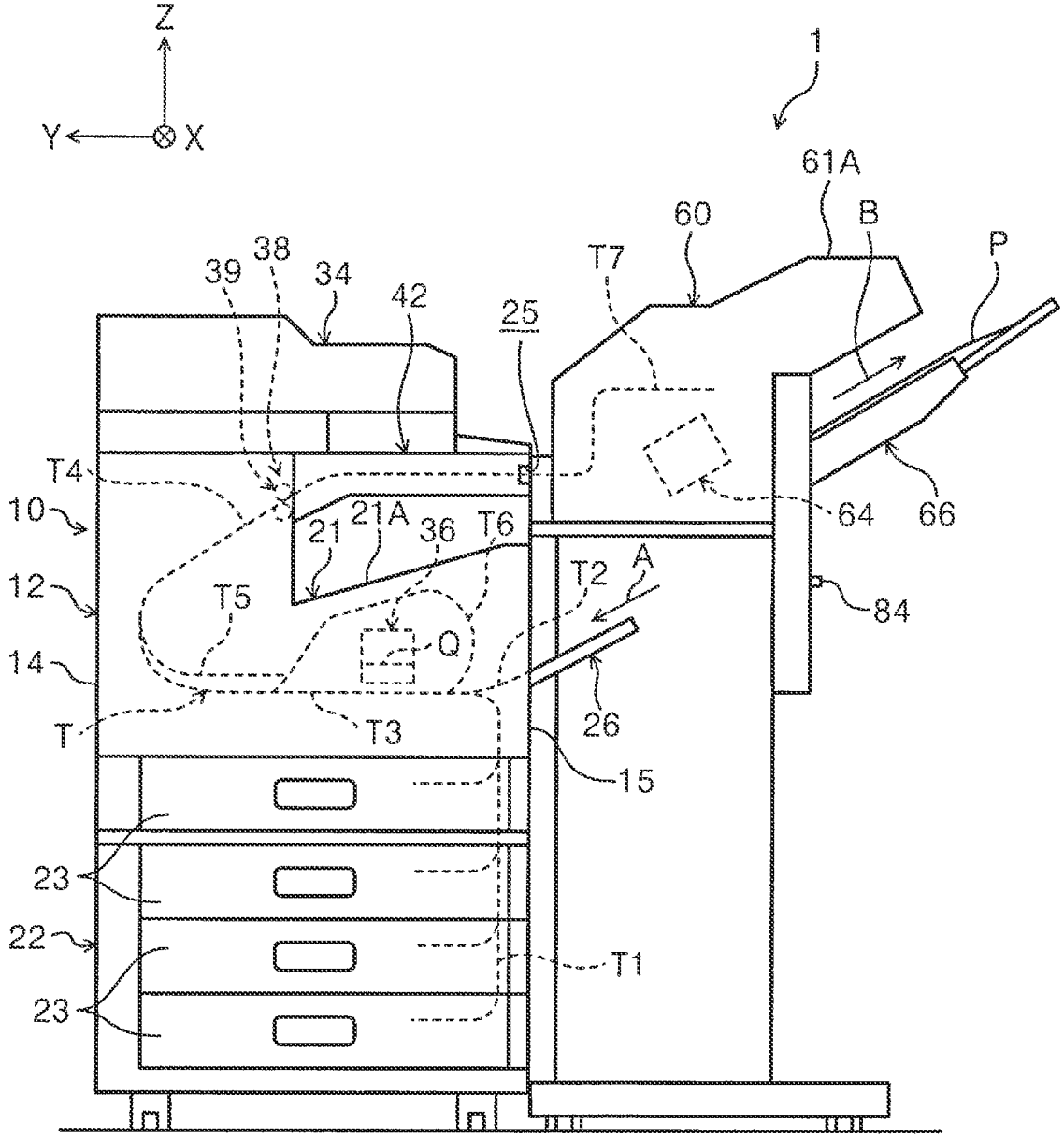
FIG. 1 illustrates the whole of the structure of a recording system in embodiment 1.

A general description of the present disclosure will be given below.

An attachment unit according to a first aspect is disposed so as to face the apparatus side surface of a recording apparatus that has a medium mounting tray protruding from the apparatus side surface. The attachment unit has an ejection tray, which is movably provided in a unit body and to which a medium accepted from the recording apparatus is ejected. In an apparatus height direction crossing a direction in which the medium is ejected, the ejection tray can be moved to a first position at which the medium that has been ejected can be mounted and to a second position at which part of a medium mounted on the medium mounting tray can be supported.

In this aspect, when a long medium larger than the size of the medium mounting tray is to be mounted, the ejection tray is moved to the second position or remains positioned at the second position, so the ejection tray can support a portion of the long medium, the portion extending from the medium mounting tray. Therefore, it is possible to restrain the long medium from dropping from the medium mounting tray.

The ejection tray can be moved to the first position and to the second position. Therefore, there is no need to adjust the height of the medium mounting tray to the height of the upper surface which is the highest position of the attachment unit. In addition, the shape of the upper surface of the attachment unit does not need to be adjusted to the shape of the medium mounting tray. This suppresses a drop in flexibility in the design of the attachment unit.

In an attachment unit in a second aspect, in the first aspect, the unit body has a processor that performs processing on the medium that has been accepted from the recording apparatus. The medium that has been processed by the processor is ejected to the ejection tray.

In this aspect, processing by the processor can be performed for the medium yet to be ejected to the ejection tray. This enables space in the unit body to be effectively used when compared with a structure in which the medium accepted from the recording apparatus is ejected to the ejection tray without any processing.

In an attachment unit in a third aspect, in the first or second aspect, the unit body has a movement section that moves the position of the ejection tray to one of the first position and the second position, according to selection information about the first position and the second position.

In this aspect, when the first position is selected as the selection information, the ejection tray is moved to the first position or is held at the first position by the movement section. When the second position is selected as the selection information, the ejection tray is moved to the second position or is held at the second position by the movement section. Since the ejection tray is automatically positioned at the first position or the second position as described above, the user does not need to manipulate the ejection tray.

In an attachment unit in a fourth aspect, in the third aspect, the movement section has a fixed portion fixed to the unit body, an opening being formed between the fixed portion and the medium mounting tray, and also has a shutter portion that opens and closes the opening by being moved in the apparatus height direction with respect to the fixed portion. The shutter portion closes the opening when the ejection tray is positioned at the first position, and opens the opening when the ejection tray is positioned at the second position.

In this aspect, when the ejection tray is positioned at the first position, the shutter portion closes the opening. Therefore, part of the medium on the medium mounting tray does not project to the outside through the opening. This can prevent the medium from being caught between the ejection tray and the unit body during the movement of the ejection tray from the first position to the second position.

When the ejection tray is positioned at the second position, the shutter portion opens the opening. Therefore, a space in which the medium mounting tray can be manipulated is increased. This makes it easy to perform an operation to mount the medium on the medium mounting tray.

In an attachment unit in a fifth aspect, in the fourth aspect, when the shutter portion is brought into contact with the ejection tray during its movement to the second position, the shutter portion opens the opening.

In this aspect, the shutter portion opens the opening when the shutter portion comes into contact with the ejection tray during its movement, receives a pressing force, and is thereby moved. This eliminates the need for a mechanism that moves the shutter portion to a position at which the opening is opened.

In an attachment unit in a sixth aspect, in the fifth aspect, a pressing section is provided that presses the shutter portion toward the closed position of the shutter portion, the opening being closed at the closed position.

In this aspect, when the contact between the ejection tray and the shutter portion is eliminated due to the movement of the ejection tray to the first position, the pressing force of the pressing section is exerted on the shutter portion. This causes the shutter portion to move to the closed position. Even when an external force is exerted on the shutter portion in a direction to open the opening, the pressing section presses the shutter portion toward the closed position. Therefore, it is possible to restrain the opening from remaining in the open state.

An image forming system in a seventh aspect has the attachment unit in any one of the first to sixth aspects, the recording apparatus that performs printing on a medium to be transported to the attachment unit, and a controller that controls the movement of the ejection tray according to input information.

In this aspect, the ejection tray can be appropriately moved according to the input information.

In an image forming system in an eighth aspect, in the seventh aspect, the unit body has an ejection port through which the medium to be ejected to the ejection tray passes. The controller uses, as the input information, information about the amount of media ejected to and stacked on the ejection tray. The controller moves the ejection tray in the apparatus height direction so that a match is made between the position of the ejection port in the apparatus height direction and the position, in the apparatus height direction, of the topmost medium ejected to the ejection tray.

In this aspect, since a match is made between the position of the ejection port in the apparatus height direction and the position, in the apparatus height direction, of the topmost medium ejected to the ejection tray, media can be stably stacked on the ejection tray.

In an image forming system in a ninth aspect, in the eighth aspect, a pass portion through which the medium can pass is formed between the medium mounting tray and the ejection tray positioned at the second position. In the movement, to the second position, of the ejection tray with media stacked, the controller moves the ejection tray in the apparatus height direction so that the upper end of the pass portion in the apparatus height direction is positioned below the topmost medium on the ejection tray in the apparatus height direction.

In this aspect, after the ejection tray with media stacked has been moved from the first position to the second position, the topmost medium of the media stacked on the ejection tray positioned at the second position is positioned above the upper end of the pass section.

Of a plurality of media stacked on the ejection tray, a medium positioned above the upper end will now be referred to as an upper medium. When the upper medium comes into contact with part of the circumferential edges of the pass portion, the movement of the upper medium is restricted. Therefore, it is possible to restrain the upper medium on the ejection tray from dropping onto the medium mounting tray.

Of the plurality of media stacked on the ejection tray, a medium facing the pass portion will be referred to as a lower medium. Since the lower medium receives a load from the upper medium, a frictional force generated between the lower medium and the upper medium is increased, restricting the movement of the lower medium toward the pass portion. Therefore, it is possible to restrain the lower medium on the ejection tray from unintentionally dropping onto the medium mounting tray.

In an image forming system in a tenth aspect, in the eighth aspect, a pass portion through which the medium can pass is formed between the medium mounting tray and the ejection tray positioned at the second position. Before the controller positions, at the second position, the ejection tray with media stacked, the controller stops the ejection tray at a position above the second position so that the media are positioned above the pass portion.

In this aspect, the media on the ejection tray are positioned above the pass portion in a state before the ejection tray with the media stacked is positioned at the second position. Therefore, when the media are stacked on the ejection tray and have yet to be transported, it is possible to prevent the media from unintentionally dropping onto the medium mounting tray through the pass portion.

In an image forming system in an eleventh aspect, in any one of the seventh to tenth aspects, the controller positions the ejection tray at the second position so that the second mounting surface of the medium mounting tray and the first mounting surface of the ejection tray at the second position are aligned in one direction.

In this aspect, when a long medium is to be mounted across the medium mounting tray and the ejection tray, the first mounting surface and the second mounting surface are aligned in the one direction. Therefore, it is possible to restrain the long medium from being deformed.

In any one of the seventh to the eleventh aspects, an image forming system in a twelfth aspect further has an input section on which the input information can be entered or modified.

In this aspect, the movement state of the ejection tray can be freely changed.

In an image forming system in a thirteenth aspect, in the twelfth aspect, a medium detection section is provided that detects whether the medium is present on at least one of the medium mounting tray and the ejection tray. On the input section, the first length of the medium to be mounted on the medium mounting tray in a transport direction can be entered or modified as the input information. When the first length that has been modified or was entered in advance on the input section is longer than the second length of the medium mounting tray in the transport direction and the medium detection section detects that the medium is not present, the controller positions the ejection tray at the second position.

In this aspect, even when the medium is a long medium, which is too long to be supported by the medium mounting tray alone, the ejection tray is positioned at the second position before the medium is mounted on the medium mounting tray, according to a detection result from the medium detection section. This means that the ejection tray assists in supporting the medium mounted on the medium mounting tray. Therefore, the long medium can be stably supported.

In an image forming system in a fourteenth aspect, in the thirteenth aspects, when the first length is longer than the second length of the medium mounting tray in the transport direction, after there is no more medium on the ejection tray, the controller moves the ejection tray from the second position to the first position.

In this aspect, after the medium has been completely fed from the ejection tray, the ejection tray is moved to the first position. Therefore, it is possible to prevent the medium from being caught between the ejection tray and the unit body and being thereby deformed.

In an image forming system in a fifteenth aspect, in the thirteenth aspects, when the first length is longer than the second length of the medium mounting tray in the transport direction, after the ejection of the medium is started, the controller positions the ejection tray between the first position and the second position.

In this aspect, after the ejection of the medium has been started, the ejection tray is positioned between the first position and the second position, forming a space between the medium and the ejection tray. This restrains the ejection tray from interfering with the user's manipulation to take the ejected medium.

In an image forming system in a sixteenth aspect, in the twelfth aspects, a selection section is provided that enables selection between a first mode in which the ejection tray is positioned at the second position and a second mode in which the ejection tray is not positioned at the second position. On the input section, the first length of the medium to be mounted on the medium mounting tray in a transport direction can be entered or modified as the input information. When the first length that has been modified or was entered in advance on the input section is shorter than the second length of the medium mounting tray in the transport direction, the controller controls whether to move the ejection tray, depending on which mode, the first mode or second mode, has been selected on the selection section.

In this aspect, even when the first length is shorter than the second length of the medium mounting tray in the transport direction, whether to move the ejection tray can be freely selected.

In an image forming system in a seventeenth aspect, in the twelfth aspect, on the input section, the first length of the medium to be mounted on the medium mounting tray in a transport direction can be entered or modified as the input information. When the first length that has been modified or was entered in advance on the input section is shorter than the second length of the medium mounting tray in the transport direction, after the medium has been mounted on the medium mounting tray with the ejection tray at the second position, the controller moves the ejection tray from the second position to the first position.

In this aspect, even when the position of part of the medium is shifted from the medium mounting tray toward the outside during the mounting of the medium on the medium mounting tray, the portion protruding due to this positional shift is supported by the ejection tray. This can suppress a drop of the medium. Furthermore, after the medium has been mounted on the medium mounting tray, the ejection tray is automatically moved to the first position. When the medium is ejected in the attachment unit, therefore, a drop of the medium can be suppressed.

In an image forming system in an eighteenth aspect, in any one of the seventh to seventeenth aspects, the medium mounting tray is provided so as to be switchable between an in-use state in which the medium can be mounted and a storage state in which the medium cannot be mounted. When the medium mounting tray is in the in-use state, the controller permits the ejection tray to be positioned at the second position.

In this aspect, when the ejection tray is at the second position, the medium mounting tray is in the in-use state. This prevents that the medium mounting tray is positioned at the second position in spite of the medium mounting tray being in the storage state. Therefore, it is possible to prevent the medium from dropping between the ejection tray and the medium mounting tray in the storage state.

Embodiment 1

A recording system 1 in embodiment 1 will be specifically described below as an example of an embodiment of the present disclosure.

The recording system 1 is an example of an image forming apparatus system as illustrated in FIG. 1. The recording system 1 has a printer 10, a post-processing unit 60 that performs post-processing on paper P ejected from the printer 10, and a controller 44 (see FIG. 3) that controls the movement of an ejection tray 66, which will be described later, according to input information. The recording system 1 is structured an ink-jet recoding system that performs recording by discharging an ink Q, which is an example of a liquid, to paper P, which is an example of a medium. The recording system 1 further has a scanner unit 34.

The X direction is an example of the apparatus depth direction of the recording system 1. A direction toward the bottom end of the arrow indicating the X direction will be referred to as the −X direction, and a direction toward the top end of the arrow indicating the X direction will be referred to as the +X direction. The X direction is an example of the width direction of paper P.

The Y direction is an example of the apparatus width direction of the recording system 1. A direction toward the top end of the arrow indicating the Y direction will be referred to as the +Y direction, and a direction toward the bottom end of the arrow indicating the Y direction will be referred to as the −Y direction.

The Z direction is an example of the apparatus height direction of the recording system 1. The Z direction is orthogonal to both the X direction and Y direction. A direction toward the top end of the arrow indicating the Z direction will be referred to as the +Z direction, and a direction toward the bottom end of the arrow indicating the Z direction will be referred to as the −Z direction. In the description below, the +Z direction will sometimes be referred to as the upward direction, and the −Z direction will sometimes be referred to as the downward direction. When the direction does not distinguish between the positive direction and the negative direction, the direction will be simply described as the X direction, Y direction, or Z direction.

A direction in which paper P advances during transport from a manual feed tray 26, which will be described below, will be referred to as a +A direction. The +A direction is an example of a transport direction. An example of the +A direction is a diagonal direction toward a position in the +Y direction and −Z direction. A direction opposite to the +A direction will be referred to a −A direction.

A direction in which paper P advances during ejection to the ejection tray 66 will be referred to as a +B direction. The +B direction is an example of an ejection direction. An example of the +B direction is a diagonal direction toward a position in the −Y direction and +Z direction. A direction opposite to the +B direction will be referred to a −B direction.

The printer 10 is an example of a recording apparatus that performs recording on paper P to be transported to the post-processing unit 60. As an example, the printer 10 has a body 12, a paper storage section 22 in which paper P is stored, a first transport section 24 (see FIG. 3) that transports paper P, a recording section 36 that performs recording on paper P, an ejection section 38 that ejects paper P, a mounting section 21 in which paper P ejected in the body is mounted, and a relay unit 42 that is disposed above the mounting section 21 and transports paper P.

The body 12 has a body frame (not illustrated), a case 14 forming the outer shape of the body 12, and the manual feed tray 26, which will be described below.

The end of the case 14 in the −Y direction has an apparatus side surface 15. An example of the apparatus side surface 15 is a surface along an X-Y plane.

The paper storage section 22 is disposed below the center of the body 12 in the Z direction. The paper storage section 22 includes four paper cassettes 23 in its structure, for example.

The first transport section 24 includes, in its structure, a pickup roller, a supply roller, a separation roller, a plurality of transport rollers, a belt unit, and a motor, which are not illustrated, as an example. The first transport section 24 forms a transport path T through which paper P is transported.

The transport path T includes a vertical transport path T1, a manual feed path T2, a straight path T3, an ejection path T4, a switchback path T5, and an inversion path T6, as an example.

The vertical transport path T1 is provided at the end of the paper storage section 22 in the −Y direction, and extends in the +Z direction. Paper P fed from a paper cassette 23 is transported through the vertical transport path T1.

The manual feed path T2 extends from the manual feed tray 26 in the +Y direction. The manual feed path T2 joins the vertical transport path T1 and is then coupled to the straight path T3. A plurality of rollers (not illustrated) including a feed roller 19 (see FIG. 4) are provided besides the manual feed path T2.

The straight path T3 straightly extends along the Y direction. The straight path T3 faces a recording section 36, which will be described later, in the Z direction. The ejection path T4 is formed in a C-shape starting from the straight path T3 and continuing until the ejection section 38, which will be described later. The switchback path T5 temporarily accepts paper P on which recording has been performed at the recording section 36. Paper P that has passed through the switchback path T5 is fed to the inversion path T6.

One part of the inversion path T6 is disposed at a position that is in the +Z direction with respect to the recording section 36 and in the −Z direction with respect to the mounting section 21. When part of the mounting section 21 is rotated, another part of the inversion path T6 can be opened.

Figure 2:
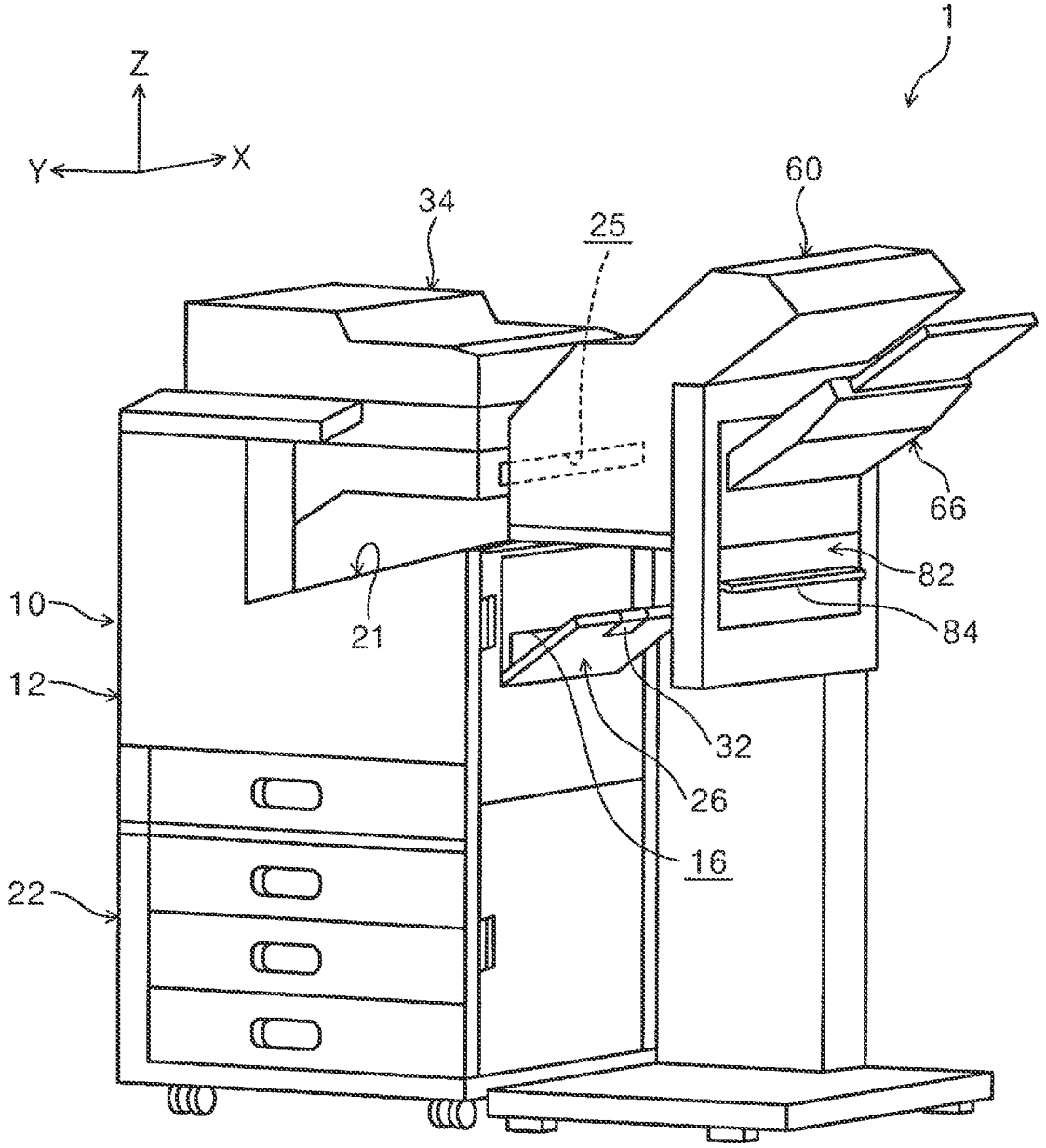
FIG. 2 is a perspective view illustrating part of the recording system in embodiment 1.

A body opening 16 in a rectangular shape is formed in part of the apparatus side surface 15 as illustrated in FIG. 2. The manual feed path T2 (see FIG. 1) passes through the body opening 16 and is then coupled to the straight path T3 (see FIG. 1). A rotational shaft 17 (see FIG. 4) is provided at the edge of the body opening 16 in the −Z direction. The rotational shaft 17 extends along the X direction.

Figure 4:
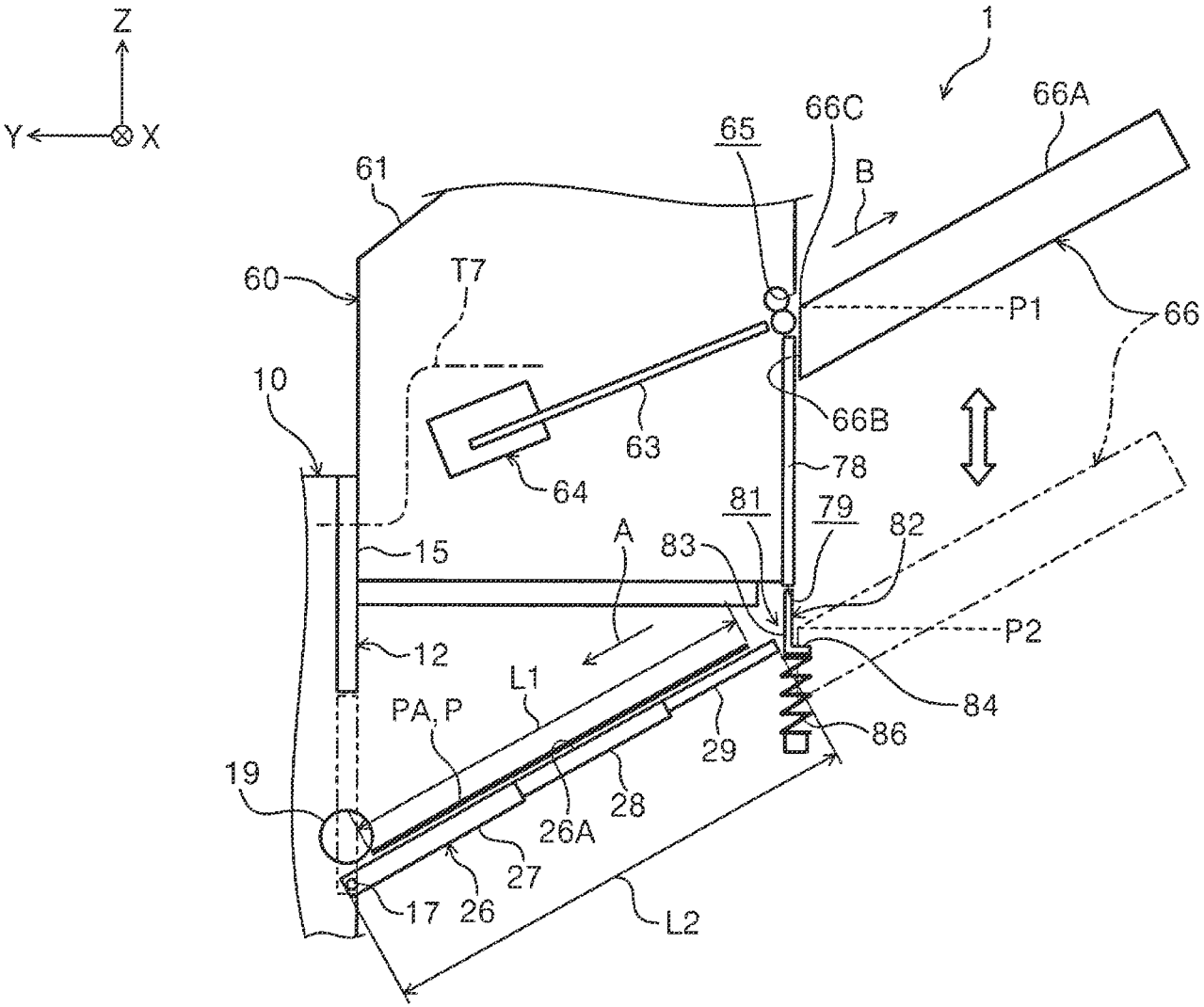
FIG. 4 is a schematic view illustrating a post-processing unit in embodiment 1 and a manual feed tray.

As illustrated in FIG. 4, the manual feed tray 26 is an example of a medium mounting tray protruding from the apparatus side surface 15 along the −A direction. The manual feed tray 26 is provided so as to be rotatable around the rotational shaft 17. That is, the manual feed tray 26 is switchable between a closed state in which the body opening 16 (see FIG. 2) is closed and an open state in which the body opening 16 is open. When the manual feed tray 26 is in the open state, paper P can be mounted on the manual feed tray 26.

The closed state of the manual feed tray 26 is equivalent to a storage state in which paper P cannot be mounted on the manual feed tray 26. The open state of the manual feed tray 26 is equivalent to an in-use state in which paper P can be mounted on the manual feed tray 26. As described above, the manual feed tray 26 is provided so as to be switchable between the in-use state and the storage state in the body 12.

A manipulation member 32 (see FIG. 2) is provided at the X-direction center of the end of the manual feed tray 26 in the +Z direction. When the manipulation member 32 engages the edges of the body opening 16, the manipulation member 32 holds the manual feed tray 26 in the closed state. Specifically, the manual feed tray 26 has a tray body 27, an extension tray 28, and an auxiliary tray 29.

When rotated around the rotational shaft 17, the tray body 27 opens and closes the body opening 16. The extension tray 28 can be stored in the tray body 27. The extension tray 28 can be drawn out of the tray body 27 in the −A direction. The auxiliary tray 29 is provided so that it can be drawn out of the extension tray 28 in the −A direction.

The length of paper P to be mounted on the manual feed tray 26 in the +A direction will be referred to as a first length L1 (mm), and the length of the manual feed tray 26 in the +A direction will be referred to as a second length L2 (mm).

Paper P used in the recording system 1 is classified into paper PA (see FIG. 4), the first length L1 of which is shorter than the second length L2 and paper PB (see FIG. 7), the first length L1 of which is longer than the second length L2, as an example. When the first length L1 is equal to the second length L2, the paper P may be classified as any one of paper PA and paper PB. In this embodiment, paper P having the first length L1 equal to the second length L2 is classified as paper PA, as an example.

With the extension tray 28 and auxiliary tray 29 drawn out, the entire surface of the manual feed tray 26 in the +Z direction will be referred to as a second mounting surface 26A. Paper P is mounted on the second mounting surface 26A. In this embodiment, the in-use state of the manual feed tray 26 indicates a state in which the second mounting surface 26A is formed, as an example.

As illustrated in FIG. 1, the scanner unit 34 is attached to the upper end of the printer 10. The scanner unit 34 reads information on an original (not illustrated).

The recording section 36 is structured as a line head, as an example. The recording section 36 has a plurality of nozzles (not illustrated) disposed so as to be across the entire area of paper P in the X direction. The recording section 36 performs recoding on paper P by discharging ink Q supplied from an ink tank (not illustrated) from the plurality of nozzles toward the paper P.

The ejection section 38 is disposed in the body 12. The ejection section 38 ejects paper P on which recording by the recording section 36 has been performed to the relay unit 42, which will be described later, or the mounting section 21. The ejection section 38 has an ejection roller pair 39, as an example. The ejection section 38 is included in the first transport section 24 (see FIG. 3), which will be described later.

A feed opening 25 is formed in the end face of the relay unit 42 in the −Y direction, the end face being part of the apparatus side surface 15. Paper P is fed through the feed opening 25 toward the post-processing unit 60, which will be described later.

The mounting section 21 is disposed in the body 12 for internal ejection, as an example. The mounting section 21 has a mounting surface 21A. The mounting surface 21A extends in a direction that crosses the Y direction and is diagonally upward toward the post-processing unit 60.

The relay unit 42 is positioned above the mounting section 21. The relay unit 42 accepts paper P ejected from the ejection section 38 and also transports the paper P to the post-processing unit 60, which will be described later.

Figure 3:
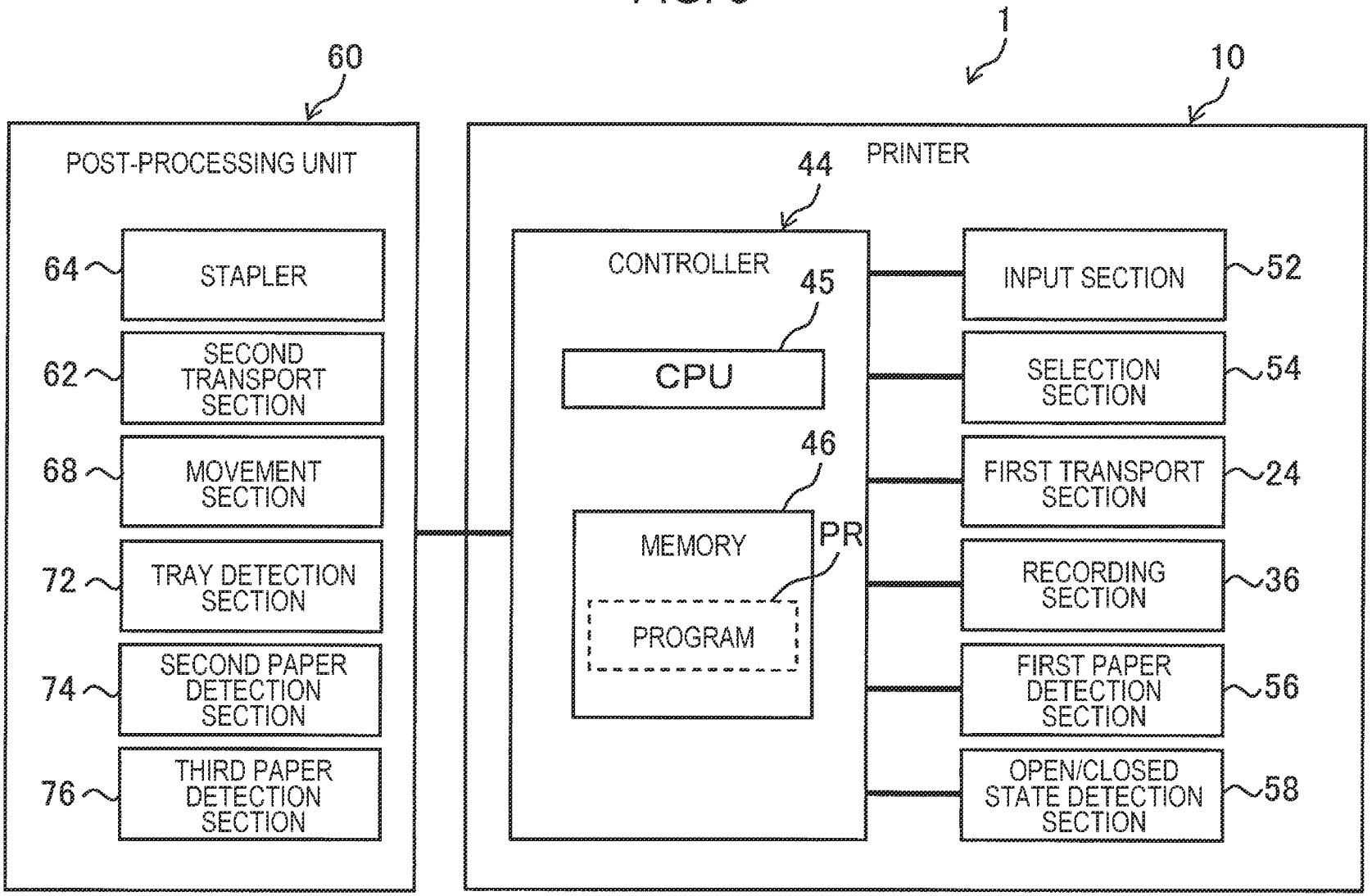
FIG. 3 is a block diagram of the recording system in embodiment 1.

As illustrated in FIG. 3, the controller 44, which functions as a computer, includes, in its structure, a central processing unit (CPU) 45, a memory 46, and a storage (not illustrated).

The controller 44 is mounted in the printer 10, as an example. The controller 44 controls the operations of the recording section 36, first transport section 24, and post-processing unit 60. The controller 44 is structured so that it can receive information from an input section 52, a selection section 54, a first paper detection section 56, and an open/closed state detection section 58. The input section 52, selection section 54, first transport section 24, first paper detection section 56, and open/closed state detection section 58 are disposed in the printer 10.

The controller 44 can control the operations of individual sections in the recording system 1. Specifically, the controller 44 uses information received from the input section 52 or selection section 54, which will be described later, or from an external unit, information stored in the memory 46, and information stored in a storage (not illustrated) as input information, and controls the operations of the recording section 36, first transport section 24, and post-processing unit 60 according to the input information.

Examples of input information include the first length L1 (see FIG. 4) of paper P, the amount of stacked paper P, the presence or absence of paper P, the position of paper P, information as to whether the manual feed tray 26 is open or closed, and the position of the ejection tray 66, which will be described later.

Various types of data including a program PR executed by the CPU 45 is stored in the memory 46. In other words, the memory 46 is an example of a recording medium in which the program PR readable by the computer is stored. Other examples of the recoding medium include a compact disc (CD), a digital versatile disc (DVD), and a Blu-ray disc, a universal serial bus (USB) memory. The program PR can be loaded into part of the memory 46.

The program PR causes the CPU 45 to execute steps, which will be described later, steps in the recording system 1.

The input section 52 is structured so that input information, described above, to be entered into the controller 44 can be entered or modified. The input section 52 includes, in its structure, a touch panel, as an example. Input information is displayed on the touch panel so that a plurality of setting parameters can be included in the input information by the user or a plurality of setting parameters included in the input information can be modified by the user. The input section 52 is structured so that it can accept the first length L1, in the +A direction, of paper P to be mounted on the manual feed tray 26.

The selection section 54 is provided so that the user can select a mode by performing a manipulation at part of the touch panel of the input section 52, as an example. Specifically, the selection section 54 is structured so that selection is possible between a first mode in which the ejection tray 66 (see FIG. 1) is positioned at a second position P2 (see FIG. 4), which will be described later, and a second mode in which the ejection tray 66 is not positioned at the second position P2. The second mode includes a case in which the ejection tray 66 is positioned at a first position P1 (see FIG. 4), which will be described later.

Selection information is used in the selection section 54 when the first length L1 is longer the second length L2.

The first paper detection section 56 is an example of a medium detection section that detects whether paper P is present on the manual feed tray 26 (see FIG. 1). The first paper detection section 56 includes, in its structure, a reflective optical sensor, as an example. Information detected by the first paper detection section 56 as to whether paper P is present is transmitted to the controller 44.

The open/closed state detection section 58 includes, in its structure, a reflective optical sensor (not illustrated) provided in the body 12 (see FIG. 1) and a reflective member (not illustrated) provided in the manual feed tray 26, as an example. By using the optical sensor to detect whether light reflected by the reflecting member is present, the open/closed state detection section 58 detects whether the manual feed tray 26 is in the in-use state or storage state.

The post-processing unit 60 has a unit body 61 (see FIG. 1), a second transport section 62, a mounting tray 63 (see FIG. 4), a stapler 64, the ejection tray 66 (see FIG. 1), a movement section 68, a tray detection section 72, a second paper detection section 74, and a third paper detection section 76. The post-processing unit 60 performs post-processing on paper P received from the printer 10. The end face of the unit body 61 in the +Z direction will be referred to as an upper surface 61A (see FIG. 1).

The second transport section 62 includes, in its structure, a plurality of transport roller pairs (no illustrated) and a motor (not illustrated), as an example. The second transport section 62 forms a post-processing path T7 (see FIG. 1), through which paper P is transported. The second transport section 62 has a function to transport paper P to the mounting tray 63 and a function to eject paper P from the mounting tray 63 to the ejection tray 66, as an example.

The mounting tray 63 is inclined along the +B direction. The length of the mounting tray 63 in the +B direction is substantially equal to the length of the second length L2, as an example.

The stapler 64 is disposed in the unit body 61. The stapler 64 performs staple processing to fasten a predetermined number of sheets of paper P together, as an example. That is, the stapler 64 is an example of a processor that performs processing on paper P accepted from the printer 10. A bundle of paper P that has been subject to staple processing by the stapler 64 is ejected from the mounting tray 63 to the ejection tray 66.

Other examples of processing on paper P include punch processing to form punch holes in paper P, bending processing to bend a bundle of paper P, cutting processing to cut paper P, signature processing to fold paper P, and bookbinding processing to bind a book from paper P.

The movement section 68 includes, in its structure, a frame (not illustrated), a linear slider (not illustrated) extending along the Z direction, and a motor (not illustrated), as an example. The movement section 68 is disposed on the side of the unit body 61 in the −Y direction. Under control of the controller 44, the movement section 68 moves the ejection tray 66 in the +Z direction and −Z direction. The movement section 68 is structured so that it can move the ejection tray 66 to the first position P1, the second position P2, and other positions in the Z direction.

The movement section 68 moves the position of the ejection tray 66 to one of the first position P1 and second position P2, according to the selection information selected on the selection section 54 about the first position P1 and second position P2. An example of the reference position of the ejection tray 66 is the position of a corner 66C (see FIG. 4), which is the end of the ejection tray 66 in the +Y direction and is also the end in the +Z direction.

The tray detection section 72 includes, in its structure, a reflective optical sensor (not illustrated) provided in the movement section 68 and a reflecting member (not illustrated) provided in the ejection tray 66, as an example. By using the optical sensor to detect whether light reflected by the reflecting member is present, the tray detection section 72 detects the position of the ejection tray 66 in the Z direction. That is, the tray detection section 72 can detect the positions, including the first position P1 and second position P2, of the ejection tray 66.

The second paper detection section 74 is an example of a medium detection section that detects whether paper P is present on the ejection tray 66. The second paper detection section 74 includes, in its structure, a reflective optical sensor, as an example. Information detected by the second paper detection section 74 as to whether paper P is present is transmitted to the controller 44.

The third paper detection section 76 detects whether paper P extending from the manual feed tray 26 in the −Y direction and positioned below the ejection tray 66 is present. The third paper detection section 76 is included in examples of medium detection sections. The third paper detection section 76 is disposed in a pass section 81 (see FIG. 4) as an example. Information detected by the third paper detection section 76 as to whether paper P is present is transmitted to the controller 44.

As illustrated in FIG. 4, the post-processing unit 60 is disposed so as to face the apparatus side surface 15 of the printer 10 in the Y direction. The post-processing unit 60 is positioned above the manual feed tray 26 in the in-use state. The unit body 61 has an ejection port 65 through which paper P to be ejected to the ejection tray 66 passes.

The ejection tray 66 is attached to the linear slider of the movement section 68 (see FIG. 3), so the ejection tray 66 is provided so as to movable at positions in the unit body 61 in the −Y direction. The ejection tray 66 is a member to which paper P that has been accepted from the printer 10 and has been processed by the stapler 64 is ejected and stacked. The ejection tray 66 extends in the +B direction, which crosses the Y direction, when viewed in the X direction. The first mounting surface 66A of the ejection tray 66 in the +Z direction is along the +B direction. The ejection tray 66 includes a side cursor (not illustrated) that suppresses a shift of paper P in the X direction.

The side surface 66B of the ejection tray 66 faces the unit body 61 in the Y direction. The side surface 66B is a flat plane along an X-Z plane. The side surface 66B is positioned so that a space is formed between the side surface 66B and a fixed wall 78 in the Y direction.

As described above, in the Z direction crossing the +B direction in which paper P is ejected, the ejection tray 66 is movable to the first position P1 at which ejected paper P can be mounted and the second position P2 at which part of paper P to be mounted on the manual feed tray 26 can be supported.

In this embodiment, the first position P1 refers to a position in a range (not illustrated) having a predetermined width in the Z direction, so the first position P1 may match the second position P2.

The movement section 68 (see FIG. 3) has the fixed wall 78, which is an example of a fixed portion fixed to the unit body 61, a shutter member 82, which is an example of a shutter portion moved in the Z direction with respect to the fixed wall 78, and a coil spring 86, which is an example of a pressing section that presses the shutter member 82 in the +Z direction.

The fixed wall 78 forms the side of the unit body 61 in the −Y direction. The fixed wall 78 is shaped like a plate having a predetermined thickness in the Y direction. The fixed wall 78 extends in the Z direction. The end of the fixed wall 78 in the +Z direction forms part of the circumferential edges of the ejection port 65. An opening 79 is formed between the manual feed tray 26 in the in-use state and the end of the fixed wall 78 in the −Z direction. The opening 79 is an example of an opening large enough for paper P to pass.

The pass portion 81 through which paper P can pass is formed between the ejection tray 66 positioned at the second position P2 and the manual feed tray 26 in the in-use state. The pass portion 81 is a space including the opening 79. The length of each of the pass portion 81 and opening 79 in the Z direction is longer than a length equivalent to the height of the maximum possible stack of paper P on the manual feed tray 26, as an example.

The shutter member 82 is guided in the Z direction by a guide member (not illustrated) provided on the fixed wall 78. When moved in the Z direction, the shutter member 82 opens the opening 79 and pass portion 81. Specifically, when the shutter member 82 is brought into contact with the ejection tray 66 during its movement to the second position P2, the shutter member 82 opens the opening 79. That is, when the ejection tray 66 is at the first position P1, the shutter member 82 closes the opening 79 and pass portion 81; when the ejection tray 66 is at the second position P2, the shutter member 82 opens the opening 79 and pass portion 81.

The shutter member 82 has a vertical wall portion 83 shaped like a plate having a predetermined thickness in the Y direction, and also has a protrusion portion 84 protruding in the −Y direction from the end of the vertical wall portion 83 in the −Z direction.

The vertical wall portion 83 is positioned in the −Z direction with respect to the fixed wall 78. The side surface of the vertical wall portion 83 in the −Y direction is substantially flush with the side surface of the fixed wall 78 in the −Y direction.

The protrusion portion 84 is formed like a plate having a predetermined thickness in the Z direction. The length, of the protrusion portion 84, by which it protrudes in the −Y direction is set so that the protrusion portion 84 and the bottom of the ejection tray 66 are brought into surface contact with each other during the downward movement of the ejection tray 66 in the −Z direction. When the ejection tray 66 is lowered in the −Z direction and comes into contact with the upper surface of the protrusion portion 84 in the +Z direction in this way, the shutter member 82 is moved in the −Z direction.

The coil spring 86 is disposed in the frame (not illustrated) of the movement section 68 (see FIG. 3) and is supported by the frame. The coil spring 86 can be elastically deformed in the Z direction. The end of the coil spring 86 in the +Z direction is attached to the end of the shutter member 82 in the −Z direction. Thus, the coil spring 86 presses the shutter member 82 toward the closed position of the shutter member 82, the opening 79 being closed at the closed position. The coil spring 86 exerts a pressing force on the shutter member 82 in the +Z direction so that the shutter member 82 can remain at the closed position.

Figure 5:
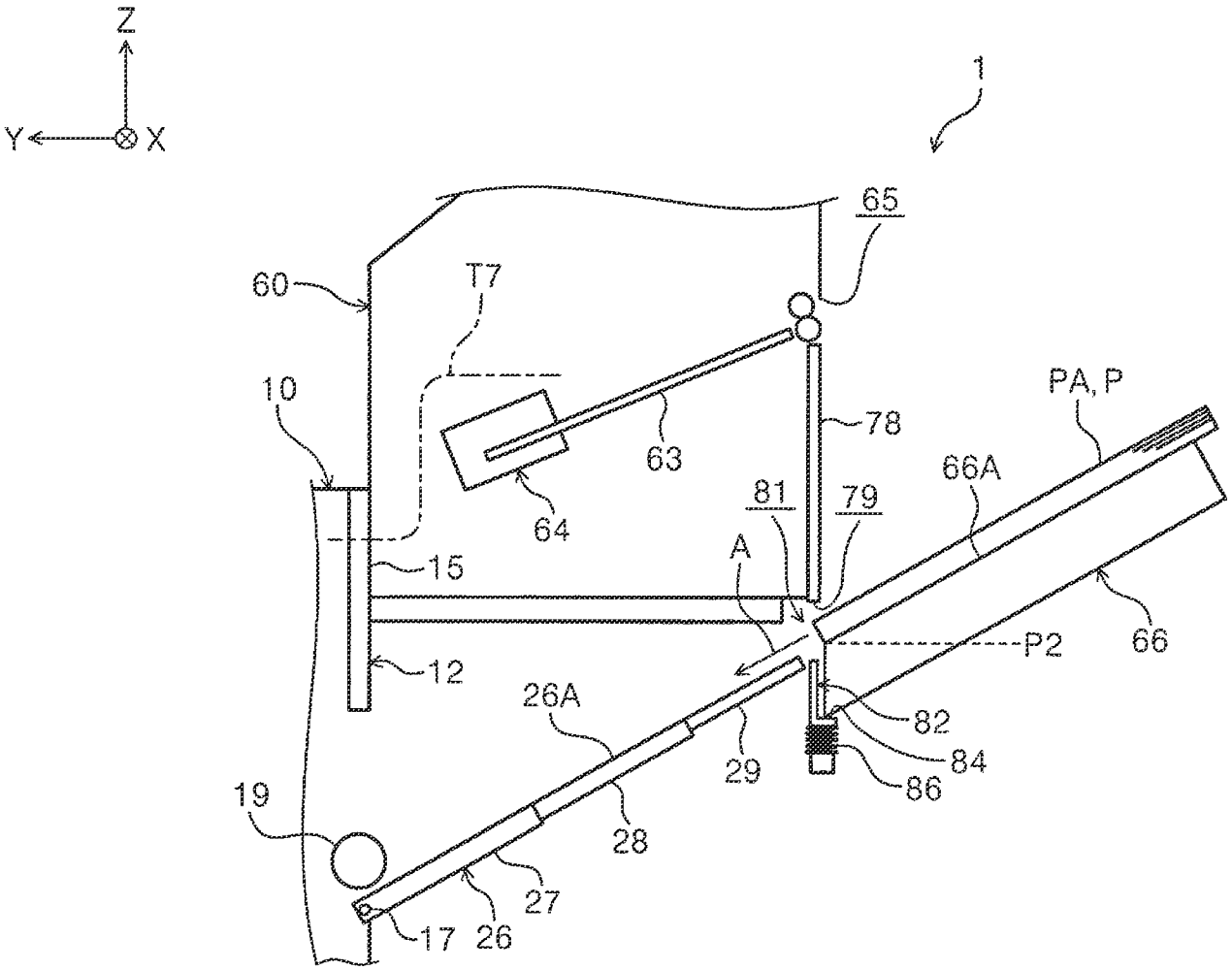
FIG. 5 is a schematic view illustrating a state in which paper is fed from an ejection tray of the post-processing unit in embodiment 1 to the manual feed tray.

When the ejection tray 66 is at the second position P2 as illustrated in FIG. 5, the shutter member 82 has been lowered in the −Z direction. In this state, paper P can pass through the opening 79 and pass portion 81. When the manual feed tray 26 is in the in-use state, the first mounting surface 66A and second mounting surface 26A are placed so as to be aligned along the +A direction, as an example. This makes it possible for paper P mounted on the first mounting surface 66A to pass through the opening 79 and pass portion 81 and then to be supplied to the second mounting surface 26A.

Figure 6:
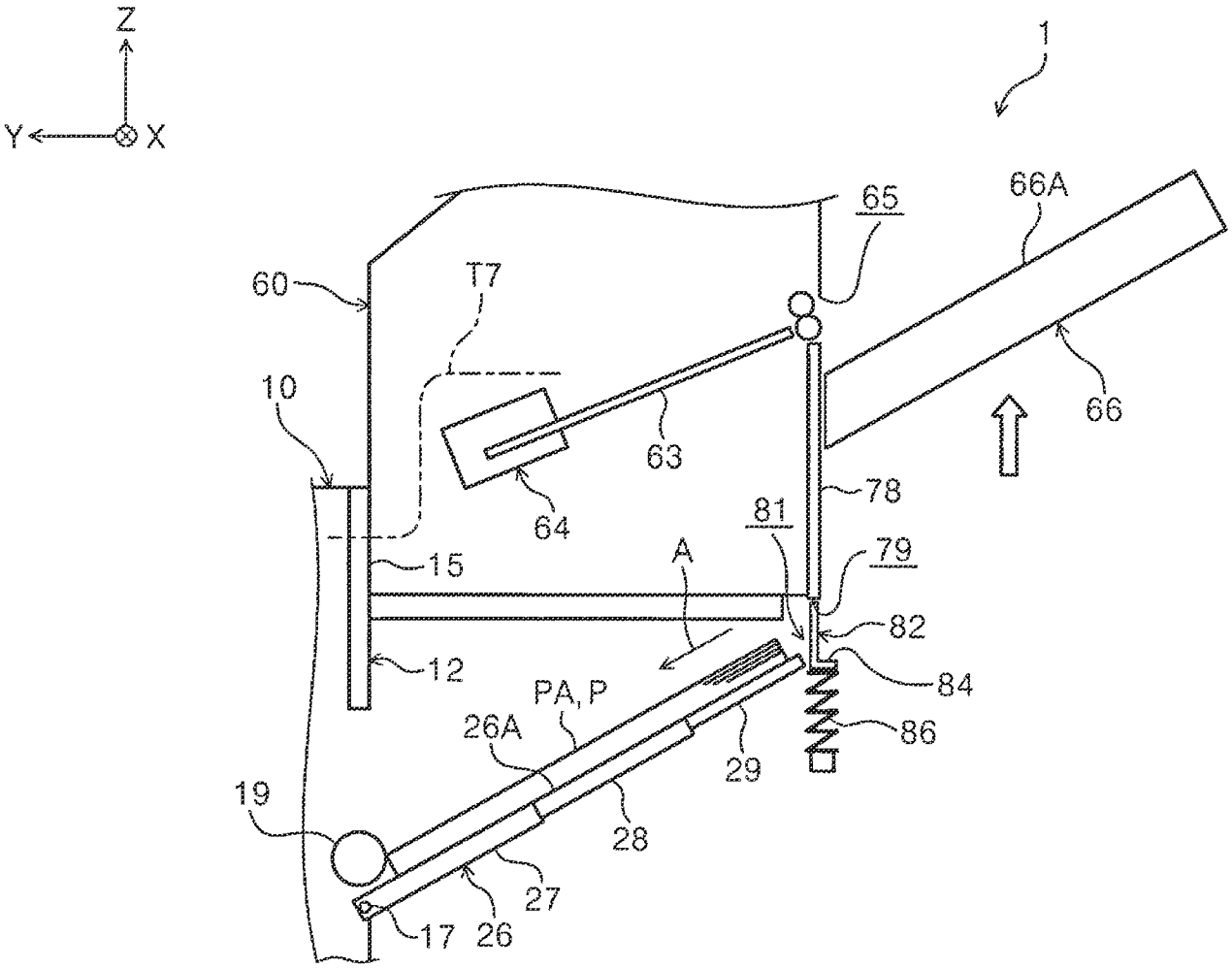
FIG. 6 is a schematic view illustrating a state in which the ejection tray of the post-processing unit in embodiment 1 is raised to a first position.

After the paper P has been supplied from the ejection tray 66 to the manual feed tray 26 as illustrated in FIG. 6, the ejection tray 66 is raised in the +Z direction toward the first position P1. Then, the external force exerted from the ejection tray 66 on the protrusion portion 84 is eliminated, so the shutter member 82 is raised due to a pressing force exerted from the coil spring 86, closing the opening 79 and pass portion 81.

Figure 7:
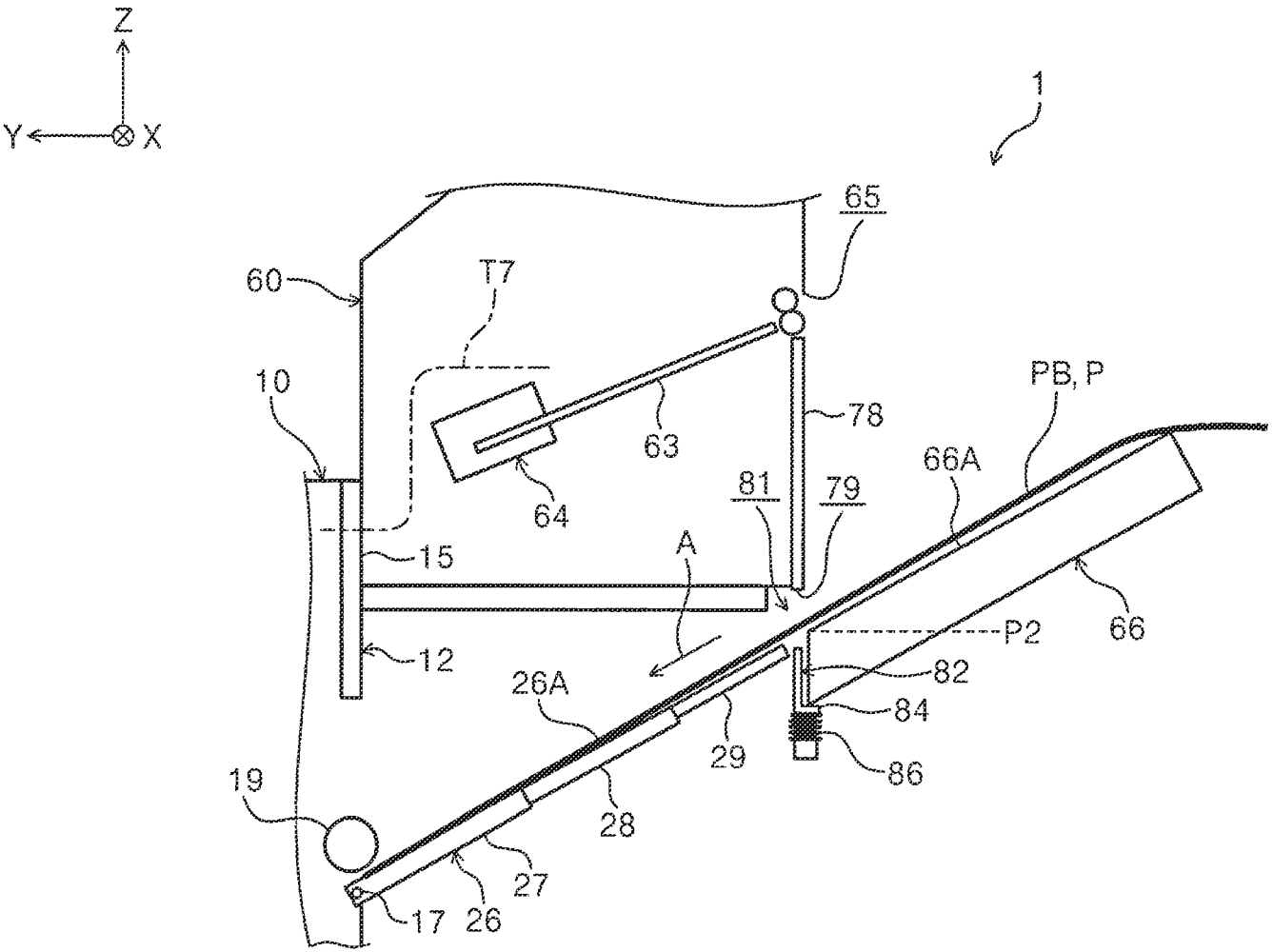
FIG. 7 is a perspective view illustrating a state in which long paper is mounted on the manual feed tray and the ejection tray of the post-processing unit in embodiment 1.

When, as illustrated in FIG. 7, the second mounting surface 26A and first mounting surface 66A are aligned in the +A direction and the opening 79 and pass portion 81 are ready for paper P to pass, paper PB, which is too large to be mounted on the second mounting surface 26A, can be mounted across the second mounting surface 26A and the first mounting surface 66A. When, in this state, the paper PB is transported, is processed, and is then ejected from the ejection port 65, the ejection tray 66 can accept the paper PB. As described above, the recording system 1 is structured so as to process paper PB as well.

Control, performed by the controller 44, in the recording system 1 will be described next. Reference characters assigned to constituent elements are as in FIGS. 1 to 7. Drawing numbers of these drawings in which these reference characters are indicated will be omitted in the description below.

The controller 44 positions the ejection tray 66 at the second position P2 so that the second mounting surface 26A of the manual feed tray 26 and the first mounting surface 66A of the ejection tray 66 at the second position P2 are aligned in the +A direction, which is an example of one direction.

When, as an example, the first length L1 that has been modified or was entered in advance on the input section 52 is longer than the second length L2 of the manual feed tray 26 in the +A direction and the third paper detection section 76 has detected that paper P is not present, the controller 44 positions the ejection tray 66 at the second position P2. When the third paper detection section 76 has detected that paper P is present, the controller 44 does not position the ejection tray 66 at the second position P2.

When, as an example, the first length L1 that has been modified or was entered in advance on the input section 52 is shorter than the second length L2 of the manual feed tray 26 in the +A direction, the controller 44 controls whether to move the ejection tray 66, depending on which mode, the first mode or second mode, has been selected on the selection section 54.

When the manual feed tray 26 is in the in-use state, the controller 44 permits the ejection tray 66 to be positioned at the second position P2.

Next, the effects of the recording system 1 and post-processing unit 60 will be described. Reference characters assigned to constituent elements in the recording system 1 and post-processing unit 60 are as in FIGS. 1 to 7. Drawing numbers of these drawings in which these reference characters are indicated will be omitted in the description below.

Figure 8:
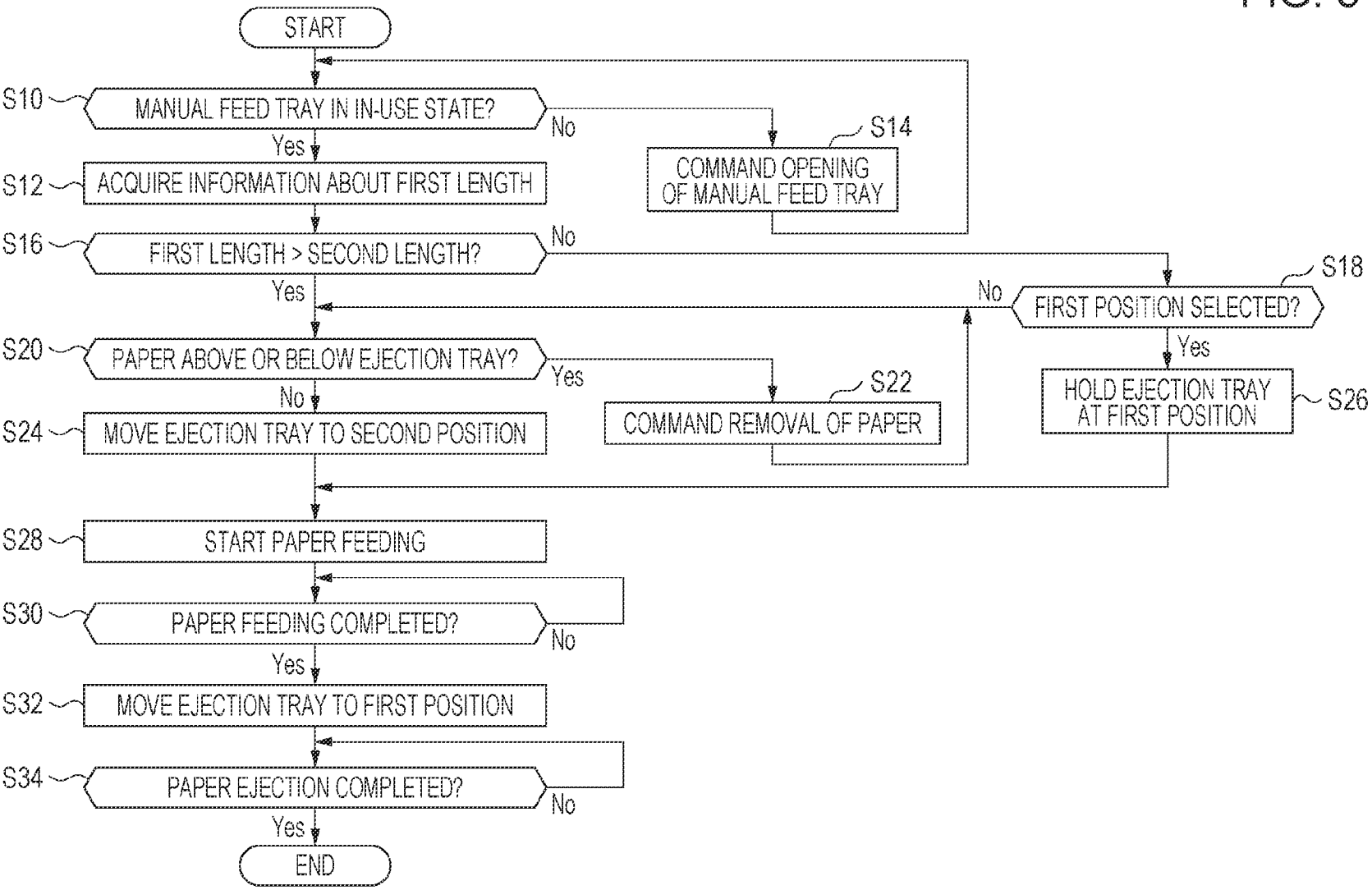
FIG. 8 is a flowchart illustrating processing in the recording system in embodiment 1.

Each process in FIG. 8 is performed when the CPU 45 reads out the program PR from the memory 46 and loads the program PR into part of the memory 46. It will be assumed that at the time of starting to process the program PR, the initial position of the ejection tray 66 is the first position P1, as an example. It will also be assumed that the start of the program PR is triggered when print data has been received in the recording system 1 and the manual feed tray 26 has been specified.

In step S10, the CPU 45 decides whether the manual feed tray 26 is in the in-use state. When the manual feed tray 26 is in the in-use state (Yes in S10), the sequence proceeds to step S12. When the manual feed tray 26 is in the storage state (No in S10), the sequence proceeds to step S14.

In step S12, the CPU 45 acquires information about the first length L1. Then, the sequence proceeds to step S16.

In step S14, the CPU 45 causes a message to be displayed on the touch panel described above to command the opening of the manual feed tray 26. An example of the message is "Open the manual tray". Then, the sequence returns to step S10.

In step S16, the CPU 45 decides whether the first length L1 is longer than the second length L2. When the first length L1 is longer than the second length L2 (Yes in S16), the sequence proceeds to step S20. When the first length L1 is shorter than the second length L2 (No in S16), the sequence proceeds to step S18.

In step S18, the CPU 45 decides whether the first position P1 has been selected on the selection section 54. When the first position P1 has been selected (Yes in S18), the sequence proceeds to step S26. When the second position P2 has been selected (No in S18), the sequence proceeds to step S20.

In step S20, the CPU 45 decides whether there is paper P above or below the ejection tray 66 according to the detection results from the second paper detection section 74 and third paper detection section 76. When there is no paper P (No in step S20), the sequence proceeds to step S24. When there is paper P (Yes in step S20), the sequence proceeds to step S22.

In step S22, the CPU 45 causes a message to be displayed on the touch panel described above to command the removal of paper P mounted on the manual feed tray 26 and ejection tray 66. An example of the message is "Remove the paper". Then, the sequence returns to step S20.

In step S24, the CPU 45 controls the operation of the movement section 68 to move the ejection tray 66 to the second position P2. The arrival of the ejection tray 66 at the second position P2 is detected by the tray detection section 72. Then, the sequence proceeds to step S28.

In step S26, to hold the ejection tray 66 at the first position P1, the CPU 45 prevents the movement section 68 from operating. Then, the sequence proceeds to step S28.

In step S28, the CPU 45 controls the operation of the first transport section 24 so that paper P starts to be fed from the manual feed tray 26 to the manual feed path T2. Then, the sequence proceeds to step S30.

In step S30, the CPU 45 decides whether the paper P has been fed from the manual feed tray 26 to the manual feed path T2. This decision may be made according to the detection result obtained for paper P from a sensor (not illustrated) provided in the printer 10. Alternatively, the decision may be made by deciding whether a first reference time calculated from the length of paper P and the feed rate of paper P has elapsed.

When the paper P has been fed (Yes in S30), the sequence proceeds to step S32. When the paper P has not been fed (No in S30), the CPU 45 repeatedly executes step S30.

In step S32, the CPU 45 controls the operation of the movement section 68 to move the ejection tray 66 to the first position P1. The arrival of the ejection tray 66 at the first position P1 is detected by the tray detection section 72. Then, the sequence proceeds to step S34.

In step S34, the CPU 45 decides whether the paper P has been ejected to the mounting tray 63. This decision may be made according to the detection result obtained for paper P from a sensor (not illustrated) provided in the printer 10. Alternatively, the decision may be made by deciding whether a second reference time calculated from the length of paper P and the ejection rate of paper P has elapsed.

When the paper P has been ejected (Yes in S34), the CPU 45 terminates the program PR. When the paper P has not been ejected (No in S34), the CPU 45 repeatedly executes step S34.

As described above, in the post-processing unit 60, when long paper PB larger than the size of the manual feed tray 26 is to be mounted on the manual feed tray 26, the ejection tray 66 is moved to the second position P2 or remains positioned at the second position P2, so the ejection tray 66 can support a portion of the long paper PB, the portion extending from the manual feed tray 26. Therefore, it is possible to restrain long paper PB from dropping from the manual feed tray 26.

The ejection tray 66 can be moved to the first position P1 and to the second position P2. Therefore, there is no need to adjust the height of the manual feed tray 26 to the height of the upper surface 61A which is the highest position of the post-processing unit 60. In addition, the shape of the upper surface 61A of the post-processing unit 60 does not need to be adjusted to the shape of the manual feed tray 26. This suppresses a drop in flexibility in the design of the post-processing unit 60.

In the post-processing unit 60, staple processing by the stapler 64 can be performed for paper P yet to be ejected to the ejection tray 66. This enables space in the unit body 61 to be effectively used when compared with a structure in which paper P accepted from the printer 10 is ejected to the ejection tray 66 without any processing.

In the post-processing unit 60, when the first position P1 is selected as selection information, the ejection tray 66 is moved to the first position P1 or is held at the first position P1 by the movement section 68. When the second position P2 is selected as selection information, the ejection tray 66 is moved to the second position P2 or is held at the second position P2 by the movement section 68. Since the ejection tray 66 is automatically positioned at the first position P1 or second position P2 as described above, the user does not need to manipulate the ejection tray 66.

In the post-processing unit 60, when the ejection tray 66 is positioned at the first position P1, the shutter member 82 closes the opening 79. Therefore, part of the paper P on the manual feed tray 26 does not project to the outside through the opening 79. This can prevent the paper P from being caught between the ejection tray 66 and the unit body 61 during the movement of the ejection tray 66 from the first position P1 to the second position P2.

In the post-processing unit 60, the shutter member 82 opens the opening 79 when the shutter member 82 comes into contact with the ejection tray 66 during its movement, receives a pressing force in the −Z direction, and is thereby moved. This eliminates the need for a mechanism that moves the shutter member 82 to a position at which the opening 79 is opened.

In the post-processing unit 60, when the contact between the ejection tray 66 and the shutter member 82 is eliminated due to the movement of the ejection tray 66 to the first position P1, the pressing force of the coil spring 86 is exerted on the shutter member 82. This causes the shutter member 82 to move to the closed position. Even when an external force is exerted on the shutter member 82 in a direction to open the opening 79, the coil spring 86 presses the shutter member 82 toward the closed position. Therefore, it is possible to restrain the opening 79 from remaining in the open state.

In the recording system 1, the ejection tray 66 can be appropriately moved according to input information described above.

In the recording system 1, when long paper PB is to be mounted across the manual feed tray 26 and the ejection tray 66, the first mounting surface 66A and second mounting surface 26A are aligned in the +A direction. Therefore, it is possible to restrain the long paper PB from being deformed.

In the recording system 1, the movement state of the ejection tray 66 can be freely changed.

In the recording system 1, even when paper P is long paper PB, which is too long to be supported by the manual feed tray 26 alone, the ejection tray 66 is positioned at the second position P2 before the paper PB is mounted on the manual feed tray 26, according to detection results from the first paper detection section 56, second paper detection section 74, and third paper detection section 76. This means that the ejection tray 66 assists in supporting the paper PB mounted on the manual feed tray 26. Therefore, long paper PB can be stably supported.

The recording system 1 has the selection section 54. Therefore, even when the first length L1 is shorter than the second length L2 of the manual feed tray 26 in the +A direction, whether to move the ejection tray 66 can be freely selected.

In the recording system 1, when the ejection tray 66 is at the second position P2, the manual feed tray 26 is in the in-use state. This prevents that the ejection tray 66 is positioned at the second position P2 in spite of the manual feed tray 26 being in the storage state. Therefore, it is possible to prevent paper P from dropping between the ejection tray 66 and the manual feed tray 26 in the storage state.

Embodiment 2

Next, the recording system 1 and post-processing unit 60 in embodiment 2 will be described with reference to the attached drawings. In the recording system 1 in embodiment 2, control by the controller 44 partially differs from control in embodiment 1, but the structure in embodiment 2 is similar to the structure in embodiment 1. As for the structure, therefore, FIGS. 1 to 7 will be referenced, but drawing numbers of these individual drawings will be omitted in the description below. Only flowcharts will be described below. The same processes as in embodiment 1 will be assigned the same step numbers and descriptions will be omitted.

When the first length L1 that has been modified or was entered in advance on the input section 52 is shorter than the second length L2 of the manual feed tray 26 in the +A direction, after paper PA has been mounted on the manual feed tray 26 with the ejection tray 66 at the second position P2, the controller 44 in embodiment 2 moves the ejection tray 66 from the second position P2 to the first position P1.

As for paper PB as well, the controller 44 performs control to move the ejection tray 66 to the second position P2 as in embodiment 1.

Next, the effects of the recording system 1 and post-processing unit 60 in embodiment 2 will be described.

Figure 9:
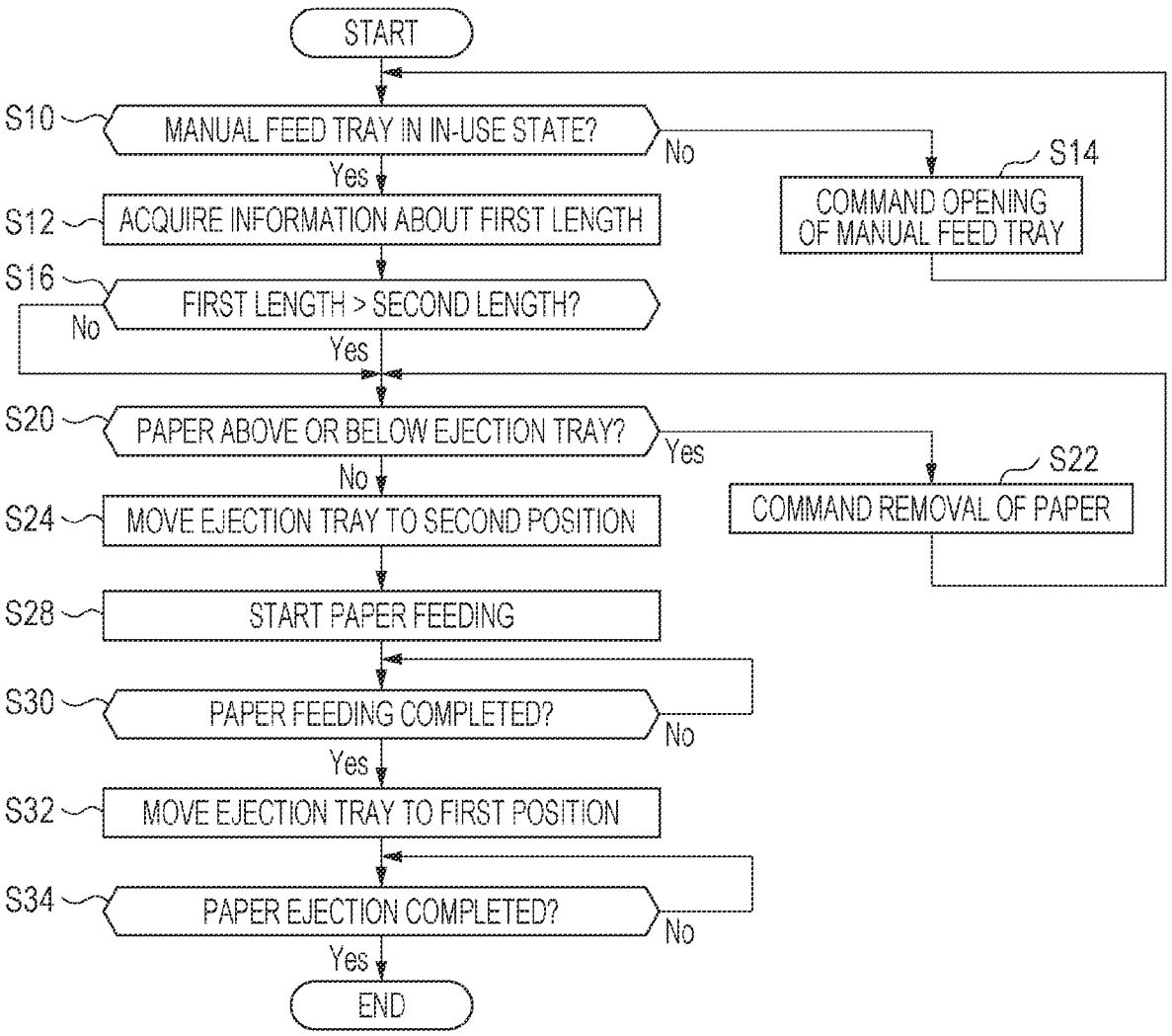
FIG. 9 is a flowchart illustrating processing in a recording system in embodiment 2.

In processing in embodiment 2, steps S18 and S26 (see FIG. 8) in embodiment 1 are eliminated as illustrated in FIG. 9.

When the CPU 45 decides, in step S16, that the first length L1 is shorter than the second length L2 (No in S16), the sequence proceeds to step S20. In embodiment 2, the sequence proceeds to step S20 regardless of which is longer in step S16, the first length L1 or the second length L2, as an example. In step S20 and later, steps similar to steps in embodiment 1 are executed.

In the recording system 1 in embodiment 2, even when the position of part of paper PA is shifted from the manual feed tray 26 toward the outside during the mounting of the paper PA on the manual feed tray 26, the portion protruding due to this positional shift is supported by the ejection tray 66. This can suppress a drop of the paper PA. Furthermore, after the paper PA has been mounted on the manual feed tray 26, the ejection tray 66 is automatically moved to the first position P1. When the paper PA is ejected in the post-processing unit 60, therefore, a drop of the paper PA is suppressed.

Embodiment 3

Next, the recording system 1 and post-processing unit 60 in embodiment 3 will be described with reference to the attached drawings. In the recording system 1 in embodiment 3, control by the controller 44 partially differs from control in embodiment 1, but the structure in embodiment 3 is similar to the structure in embodiment 1. As for the structure, therefore, FIGS. 1 to 7 will be referenced, but drawing numbers of these individual drawings will be omitted in the description below. Only flowcharts will be described below. The same processes as in embodiment 1 will be assigned the same step numbers and descriptions will be omitted.

When the first length L1 is longer than the second length L2 of the manual feed tray 26 in the +A direction, after there is no more paper PB on the ejection tray 66, the controller 44 in embodiment 3 moves the ejection tray 66 from the second position P2 to the first position P1.

Next, the effects of the recording system 1 and post-processing unit 60 in embodiment 3 will be described.

Figure 10:
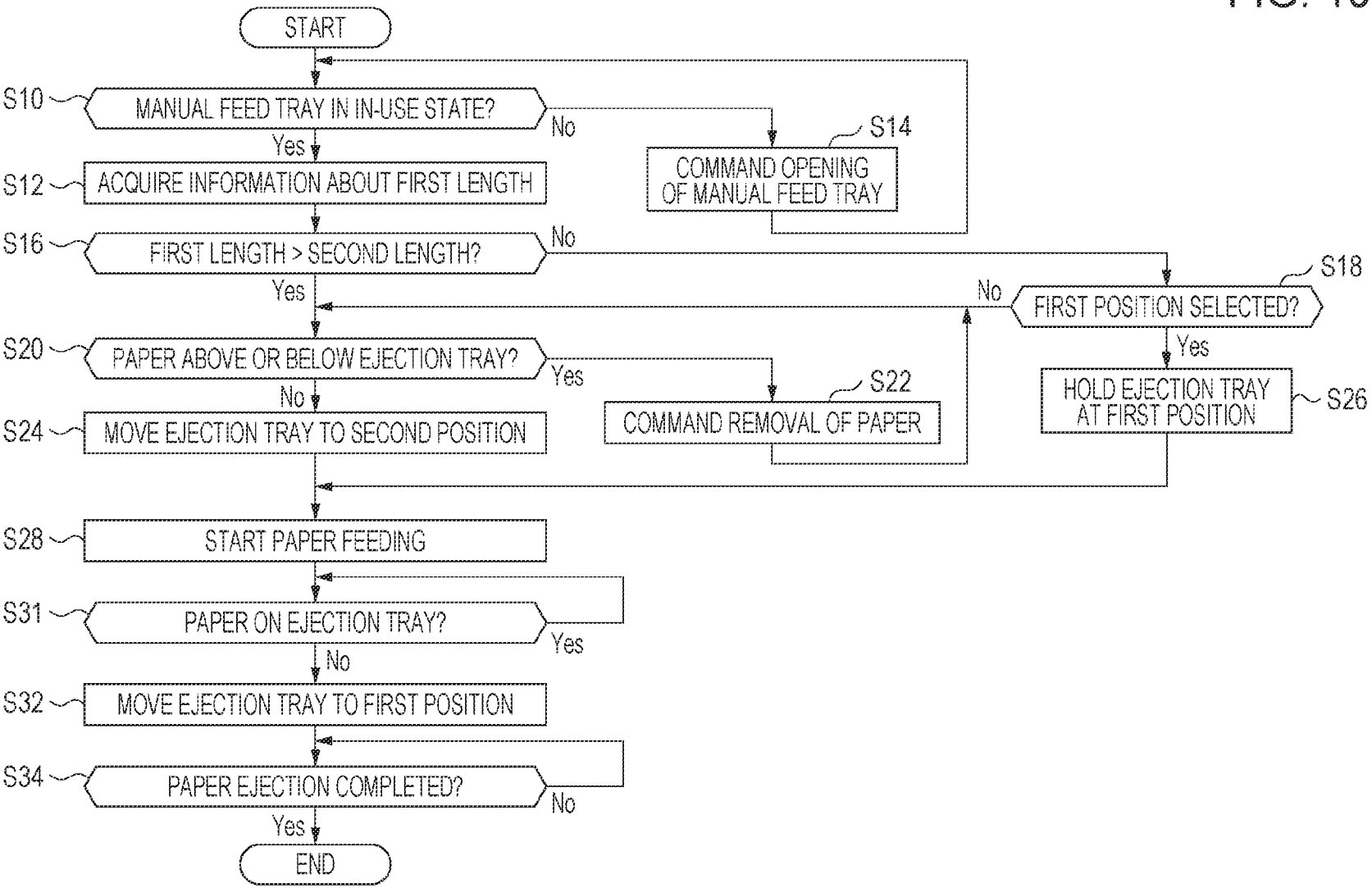
FIG. 10 is a flowchart illustrating processing in a recording system in embodiment 3.

In processing in embodiment 3, step S31 is set instead of step S30 (see FIG. 8) in embodiment 1, as illustrated in FIG. 10.

After step S28 has been executed, the sequence proceeds to step S31.

In step S31, the CPU 45 decides whether there is no more paper PB on the ejection tray 66, according to the detection result from the second paper detection section 74. When no paper PB remains (No in S31), the sequence proceeds to step S32. When paper PB remains (Yes in S31), the CPU 45 repeatedly executes step S31. In step S32 and later, steps similar to steps in embodiment 1 are executed.

In the recording system 1 in embodiment 3, after paper PB has been completely fed from the ejection tray 66, the ejection tray 66 is moved to the first position P1. Therefore, it is possible to prevent long paper PB from being caught between the ejection tray 66 and the unit body 61 and being thereby deformed.

Furthermore, the ejection tray 66 is not moved to the first position P1 until the paper PB has been completely fed from the ejection tray 66. Therefore, paper PB can be successively supplied to the printer 10 by mounting a plurality of sheets of paper PB and starting the supply of them.

Embodiment 4

Next, the recording system 1 and post-processing unit 60 in embodiment 4 will be described with reference to the attached drawings. In the recording system 1 in embodiment 4, control by the controller 44 partially differs from control in embodiment 1, but the structure in embodiment 4 is similar to the structure in embodiment 1. As for the structure, therefore, FIGS. 1 to 7 will be referenced, but drawing numbers of these individual drawings will be omitted in the description below. Only flowcharts will be described below. The same processes as in embodiment 1 will be assigned the same step numbers and descriptions will be omitted.

When the first length L1 is longer than the second length L2 of the manual feed tray 26 in the +A direction, after the ejection of paper PB is started, the controller 44 in embodiment 4 moves the ejection tray 66 to a third position P3, which is present between the first position P1 and the second position P2.

Figure 11:
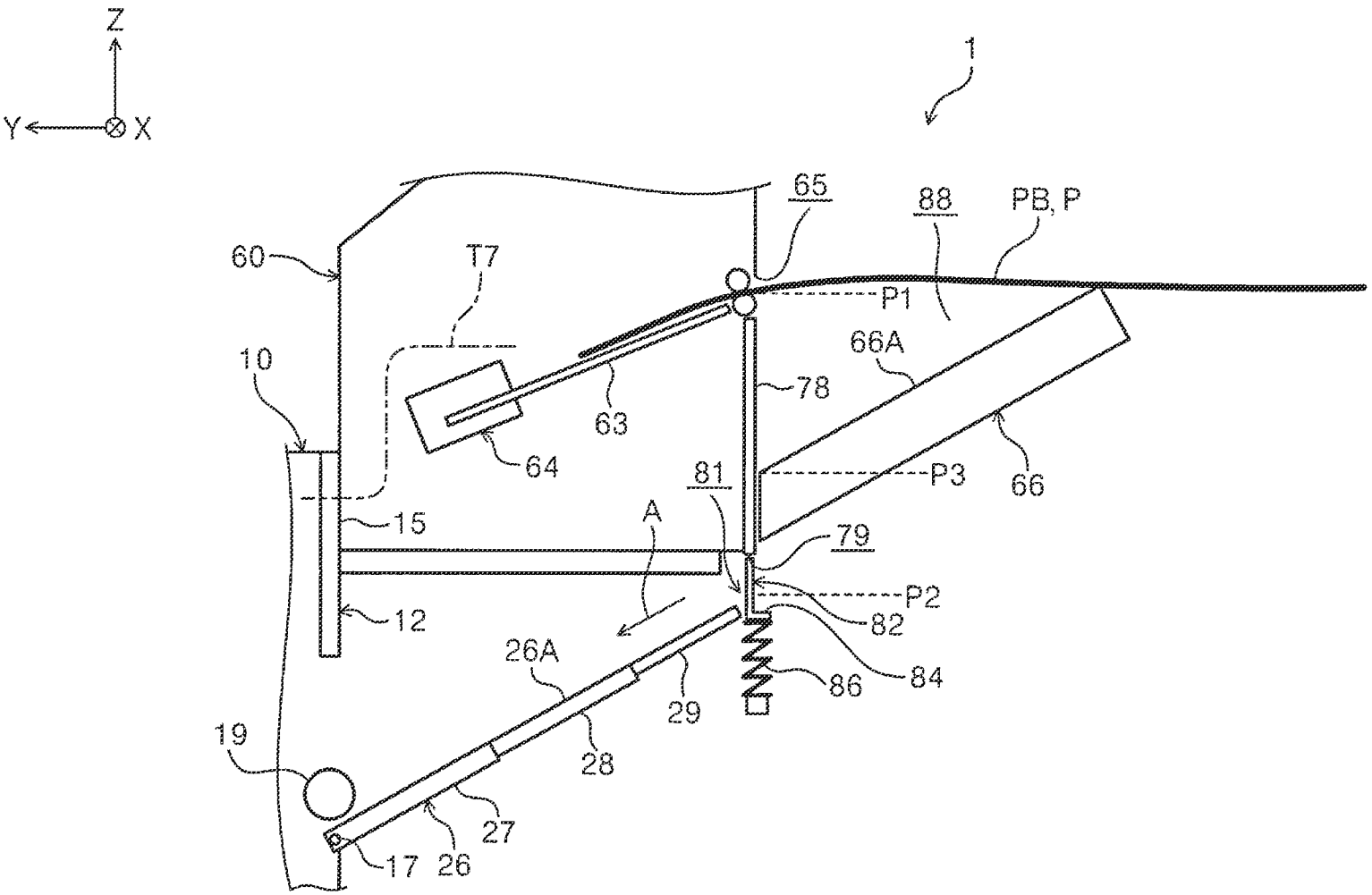
FIG. 11 is a schematic view illustrating a state in which long paper is fed from a post-processing unit in embodiment 4.

When the ejection of long paper PB is in progress as illustrated in FIG. 11, it will be assumed that the ejection tray 66 is positioned at the third position P3 between the first position P1 and the second position P2 in the Z direction. The third position P3 is set so that the end of the ejection tray 66 in the +Z direction can be brought into contact with the ejected paper PB.

When paper PB has been ejected and the ejection tray 66 is positioned at the third position P3, a space 88 is formed between the paper PB and the ejection tray 66. The user (not illustrated) can take the paper PB by inserting the hand into the space 88.

Next, the effects of the recording system 1 and post-processing unit 60 in embodiment 4 will be described.

Figure 12:
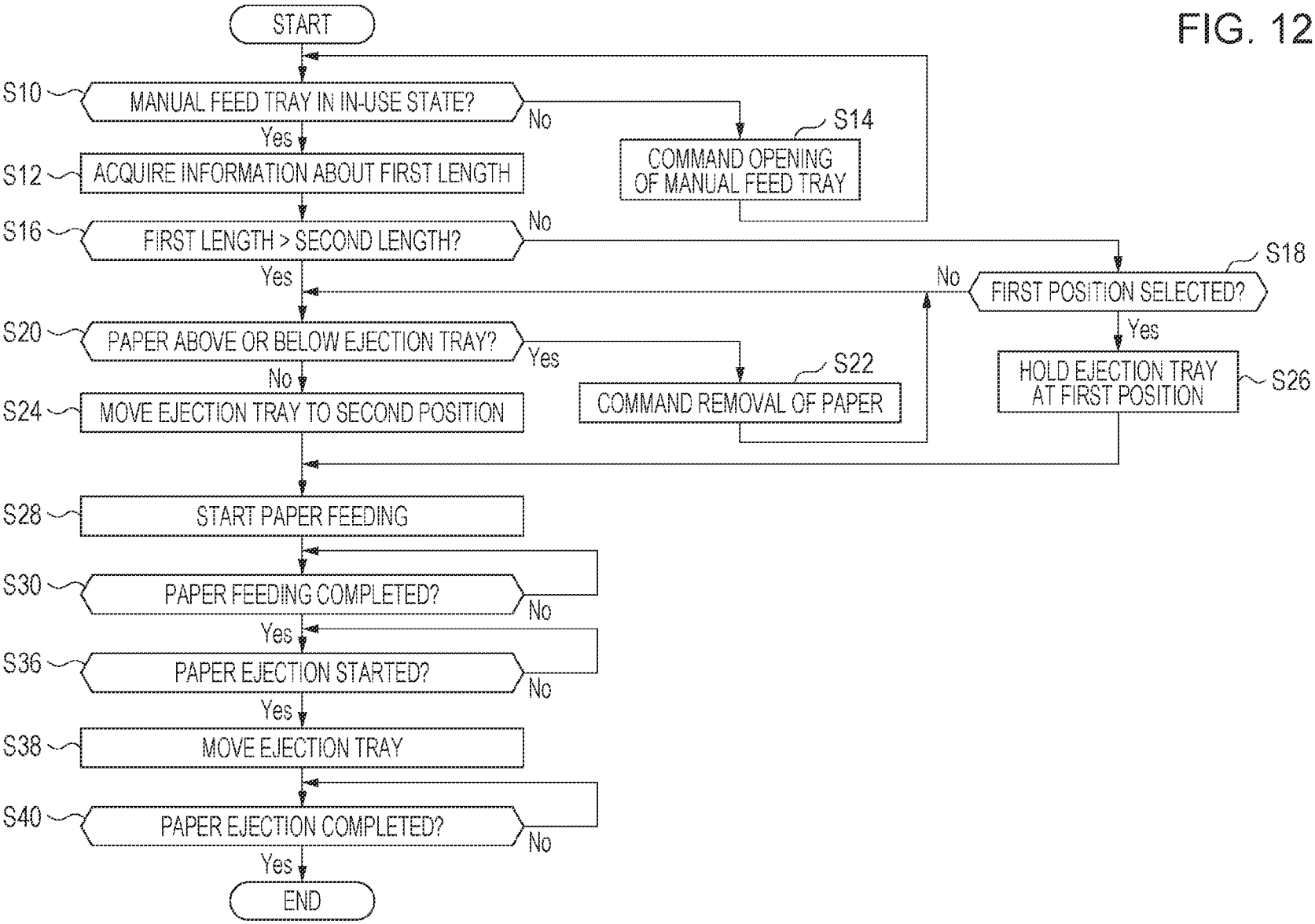
FIG. 12 is a flowchart illustrating processing in a recording system in embodiment 4.

In processing in embodiment 4, steps S36, S38, and S40 are set instead of steps S32 and S34 (see FIG. 8) in embodiment 1, as illustrated in FIG. 12.

After step S30 has been executed, the sequence proceeds to step S36.

In step S36, the CPU 45 decides whether the ejection of paper PB from the ejection port 65 has been started. This decision may be made according to the detection result obtained for paper PB from a sensor (not illustrated) provided in the printer 10.

When the ejection of paper PB has been started (Yes in S36), the sequence proceeds to step S38. When the ejection of paper PB has yet to be started (No in S36), the CPU 45 repeatedly executes step S36.

In step S38, the CPU 45 moves the ejection tray 66 from the second position P2 to the third position P3, after which the sequence proceeds to step S40.

In step S40, the CPU 45 decides whether the paper PB has been completely ejected from the ejection port 65, according to the detection result obtained for paper PB from the sensor (not illustrated) described above. When the ejection has been completed (Yes in S40), the CPU 45 terminates the program PR. When the ejection has yet to be completed (No in S40), the CPU 45 repeatedly executes step S40.

Before terminating the program PR, the CPU 45 may move the ejection tray 66 to the first position P1.

In the recording system 1 in embodiment 4, after the ejection of paper PB has been started, the ejection tray 66 is positioned between the first position P1 and the second position P2, forming the space 88 between the paper PB and the ejection tray 66. This restrains the ejection tray 66 from interfering with the user's manipulation to take the ejected paper PB.

Control to position the ejection tray 66 between the first position P1 and the second position P2 is not limited to control to stop the ejection tray 66 at an intermediate point during the movement of the ejection tray 66 from the second position P2 toward the first position P1. The ejection tray 66 positioned at the first position P1 may be lowered toward the second position P2 at the same time as when the ejection of paper PB is started.

Embodiment 5

Next, the recording system 1 and post-processing unit 60 in embodiment 5 will be described with reference to the attached drawings. In the recording system 1 in embodiment 5, control by the controller 44 partially differs from control in embodiments 1 and 4, but the structure in embodiment 5 is similar to the structure in embodiments 1 and 4.

The controller 44 acquires, as input information, information about the amount of paper P ejected to and stacked on the ejection tray 66. The controller 44 also moves the ejection tray 66 in the Z direction so that a match is made between the position of the ejection port 65 in the Z direction and the position, in the Z direction, of the topmost paper P ejected to the ejection tray 66. In other words, the larger the amount of paper P stacked on the ejection tray 66 is, the more the controller 44 lowers the ejection tray 66 from the first position P1 in the −Z direction. These arrangements are similar to the relevant arrangements in embodiment 4.

Figure 13:
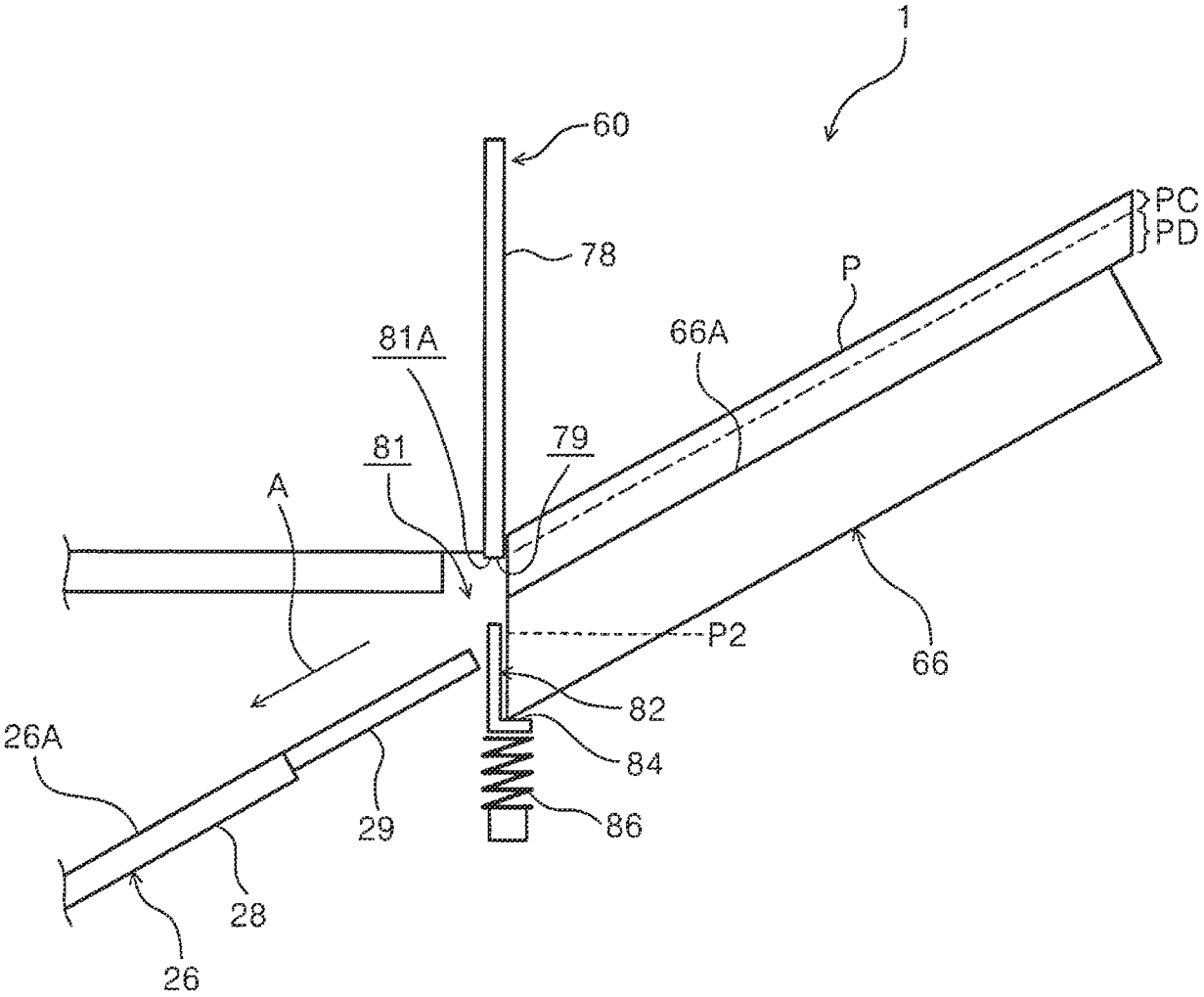
FIG. 13 is a schematic view illustrating a state in which paper is mounted on an ejection tray of a post-processing unit in embodiment 5.

In the movement, to the second position P2, of the ejection tray 66 with paper P stacked, the controller 44 (see FIG. 3) moves the ejection tray 66 in the Z direction and then stops the movement so that the upper end 81A of the pass portion 81 in the Z direction is positioned below the topmost paper P on the ejection tray 66 in the Z direction, as illustrated in FIG. 13. In other words, the controller 44 is structured so as to move the ejection tray 66 from the second position P2 to an arbitrary position in the +Z direction, according to the position of the topmost paper P on the ejection tray 66.

Next, the effects of the recording system 1 and post-processing unit 60 in embodiment 5 will be described. However, effects similar to those in embodiments 4 will not be described.

In the recording system 1 in embodiment 5, when the ejection tray 66 with paper P stacked has been moved from the first position P1 to the second position P2, at least the topmost paper P of the stack of paper P on the ejection tray 66 at the second position P2 is positioned above the upper end 81A of the pass portion 81.

Of a plurality of sheets of paper P stacked on the ejection tray 66, paper P positioned above the upper end 81A will now be referred to as upper paper PC as an example of an upper medium. When the upper paper PC comes into contact with part of the circumferential edges of the pass portion 81, the movement of the upper paper PC is restricted. Therefore, it is possible to restrain the upper paper PC on the ejection tray 66 from dropping onto the manual feed tray 26.

Of the plurality of sheets of paper P stacked on the ejection tray 66, paper P facing the pass portion 81 will be referred to as lower paper PD as an example of a lower medium. Since the lower paper PD receives a load from the upper paper PC, a frictional force generated between the lower paper PD and the upper paper PC is increased, restricting the movement of the lower paper PD toward the pass portion 81. Therefore, it is possible to restrain the lower paper PD on the ejection tray 66 from unintentionally dropping onto the manual feed tray 26.

Embodiment 6

Next, the recording system 1 and post-processing unit 60 in embodiment 6 will be described with reference to the attached drawings. In the recording system 1 in embodiment 6, control by the controller 44 partially differs from control in embodiment 1, but the structure in embodiment 6 is similar to the structure in embodiment 1.

The controller 44 acquires, as input information, information about the amount of paper P ejected to and stacked on the ejection tray 66. The controller 44 also moves the ejection tray 66 in the Z direction so that a match is made between the position of the ejection port 65 in the Z direction and the position, in the Z direction, of the topmost paper P ejected to the ejection tray 66. In other words, the controller 44 is structured so that the larger the amount of paper P stacked on the ejection tray 66 is, the more the controller 44 lowers the ejection tray 66 from the first position P1 in the −Z direction.

Figure 14:
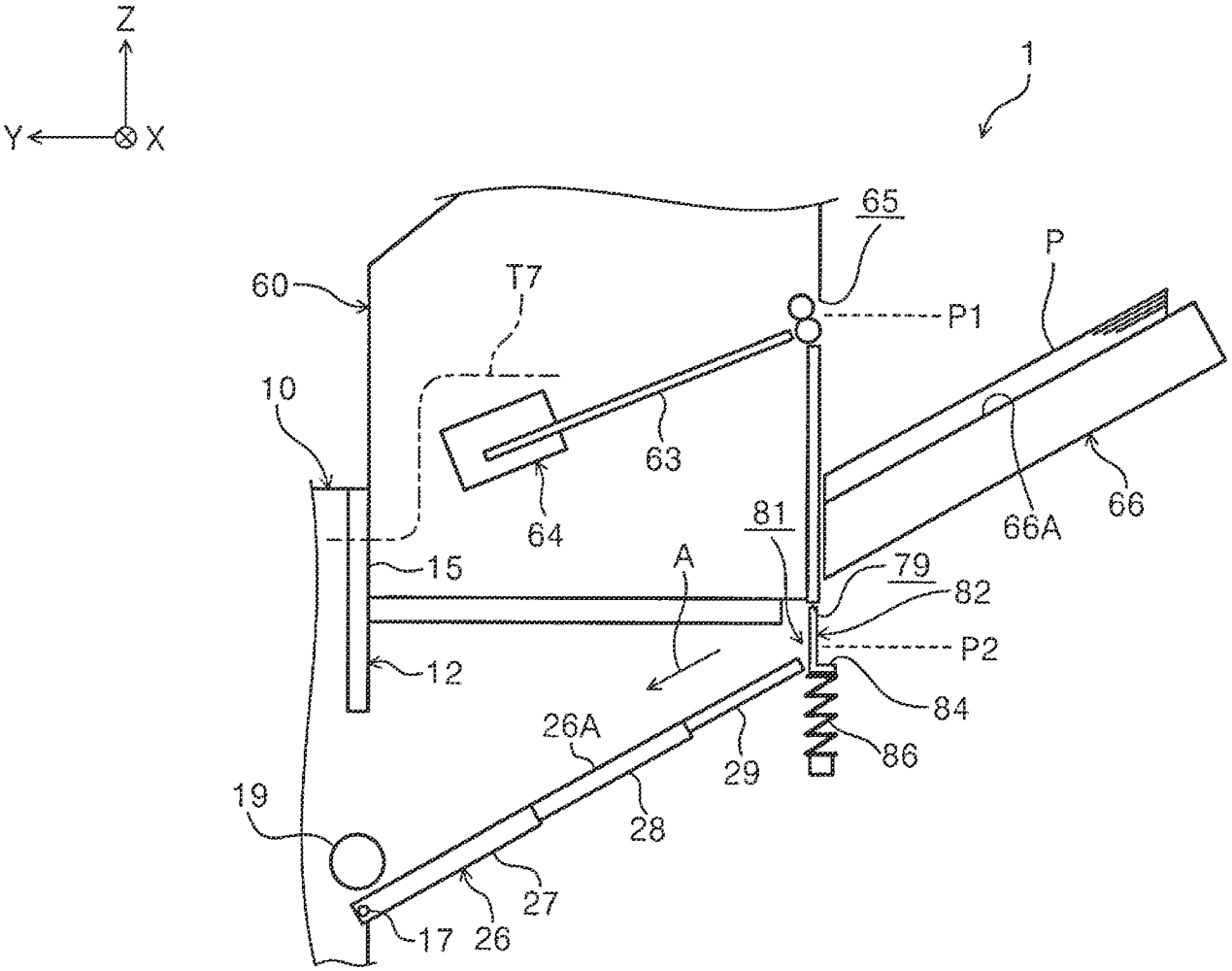
FIG. 14 is a schematic view illustrating a state in which paper is mounted on an ejection tray of a post-processing unit in embodiment 6.

The controller 44 (see FIG. 3) has a structure in which before the controller 44 positions, at the second position P2, the ejection tray 66 with paper P stacked, the controller 44 stops the ejection tray 66 at a position above the second position P2 so that the paper P is positioned above the pass portion 81, as illustrated in FIG. 14.

Next, the effects of the recording system 1 and post-processing unit 60 in embodiment 6 will be described. However, effects similar to the effects of the recording system 1 and post-processing unit 60 in embodiments 5 will not be described.

In the recording system 1 in embodiment 6, paper P on the ejection tray 66 is positioned above the pass portion 81 in a state before the ejection tray 66 with paper P stacked is positioned at the second position P2. Therefore, when paper P is stacked on the ejection tray 66 and has yet to be transported, it is possible to prevent the paper P from unintentionally dropping onto the manual feed tray 26 through the pass portion 81.

In the recording system 1 and post-processing unit 60 in embodiments 1 to 6, long paper PB is supported in a wider range, so the paper PB is less likely to drop even when the user does not support the paper PB with the hand. Since the paper PB is supported in a wider range, a skew is suppressed during the feed of the paper PB, that is, during the supply of the paper PB, it is possible to enhance precision in printing.

As a comparative example, a structure will be assumed in which long paper PB is curved and supported in the curved state by using an upper tray and a lower tray, which are separated from each other in the Z direction. In the structure in the comparative example, the downstream portion of the paper PB in the transport direction is supported by the lower tray, and the upstream portion is supported by the upper tray. In the transport of a plurality of stacked sheets of paper PB, the upstream portion of paper PB, on the upper tray, to be transported receives a load from other paper PB. This increases a load in the transport of paper PB.

In the recording system 1 and post-processing unit 60 in embodiments 1 to 6, however, a substantially flat mounting surface is formed by the manual feed tray 26 and ejection tray 66. In the transport of a plurality of sheets of paper PB, therefore, the paper PB to be transported is not subject to a load depending on the mass of other paper PB. That is, paper PB is likely to be transported, so paper PB can be successively supplied.

Basically, examples of the image forming system and attachment unit in embodiments 1 to 6 have a structure described above. If preferred, part of the structure can be modified or omitted without departing from the intended scope of the disclosure of the present application.

In embodiment 1, the post-processing unit 60 may have a processor other than the stapler 64. Alternatively, the post-processing unit 60 may be a unit that only ejects paper P without having a processor such as the stapler 64. For example, the drying of paper P may be facilitated by extending a path through which paper P is transported.

The post-processing unit 60 may have a structure in which the movement section 68 is not provided. That is, the post-processing unit 60 may be structured so that the ejection tray 66 is manually moved to the first position P1 and to the second position P2.

The post-processing unit 60 is not a limited to a structure in which the ejection tray 66 is used to open or close the opening 79. The post-processing unit 60 may use a motor to open or close the shutter member 82. When the shutter member 82 is driven by a motor, a pressing portion such as the coil spring 86 may not be provided. When the ejection tray 66 is at the first position P1, the opening 79 may be open.

The first mounting surface 66A of the post-processing unit 60 may not be aligned with the second mounting surface 26A in one direction. The movement of the ejection tray 66 may be controlled according to input information stored in advance, without the input section 52 being provided. The selection section 54 may not be provided. The input section 52 may accept an input from an external computer in the recording system 1 or from an external unit such as a smartphone.

The manual feed tray 26 is not limited to a structure in which the manual feed tray 26 is switchable between the in-use state and the storage state. The manual feed tray 26 may be structured so that paper P is not stored. After the ejection tray 66 has been moved to the second position P2, the manual feed tray 26 may be placed in the in-use state, in which the manual feed tray 26 is in the open state.

In the recording system 1 in embodiments 2 to 6, a common structure similar to a structure in embodiment 1 may be replaced by a structure in a variation in embodiment 1.

In the recording system 1 in embodiments 5 and 6, there may be no match between the position of the ejection port 65 in the Z direction and the position of the topmost paper P ejected to the ejection tray 66 and oriented in the Z direction.

The medium mounting tray is not limited to the manual feed tray 26, to which paper P is fed. The medium mounting tray may be a tray to which paper P is ejected. The positional relationship between the first position P1 and the second position P2 may be vertically reversed. The amount of stacked paper P may be detected by detecting the height of the stack of paper P or calculating the amount of stacked paper P from the number of sheets of paper P.

What is claimed is:

1. An attachment unit disposed so as to face an apparatus side surface of a recording apparatus that has a medium mounting tray protruding from the apparatus side surface of the recording apparatus, the attachment unit comprising:

a unit body; and an ejection tray movably provided in the unit body, a medium accepted from the recording apparatus being ejected to the ejection tray; wherein in an apparatus height direction crossing a direction in which the medium is ejected, the ejection tray is configured to be moved to a first position at which the medium that was ejected is mounted and to a second position at which part of the medium mounted on the medium mounting tray protruding from the apparatus side surface of the recording apparatus is supported.

2. The attachment unit according to claim 1, wherein:

the unit body has a processor that performs processing on the medium that was accepted from the recording apparatus; and the medium that was processed by the processor is ejected to the ejection tray.

3. The attachment unit according to claim 1, wherein the unit body has a movement section that moves a position of the ejection tray to one of the first position and the second position, according to selection information about the first position and the second position.

4. The attachment unit according to claim 3, wherein:

the movement section has a fixed portion fixed to the unit body, an opening being formed between the fixed portion and the medium mounting tray, and a shutter portion that opens and closes the opening by being moved in the apparatus height direction with respect to the fixed portion; and the shutter portion closes the opening when the ejection tray is positioned at the first position, and opens the opening when the ejection tray is positioned at the second position.

5. The attachment unit according to claim 4, wherein when the shutter portion brought into contact with the ejection tray during movement of the ejection tray to the second position, the shutter portion opens the opening.

6. The attachment unit according to claim 5, further comprising a pressing section that presses the shutter portion toward a closed position of the shutter portion, the opening being closed at the closed position.

7. An image forming system comprising:

the attachment unit in claim 1;

the recording apparatus that performs printing on a medium to be transported to the attachment unit; and a controller that controls movement of the ejection tray according to input information.

8. The image forming system according to claim 7, wherein:

the unit body has an ejection port through which the medium to be ejected to the ejection tray passes; and the controller uses, as the input information, information about an amount of medium ejected to and stacked on the ejection tray, and moves the ejection tray in the apparatus height direction so that a match is made between a position of the ejection port in the apparatus height direction and a position, in the apparatus height direction, of a topmost medium ejected to the ejection tray.

9. The image forming system according to claim 8, wherein: a pass portion is formed between the medium mounting tray and the ejection tray positioned at the second position, the pass portion being configured to enable the medium to passes through the pass portion; and in movement, to the second position, of the ejection tray with the medium stacked, the controller moves the ejection tray in the apparatus height direction so that an upper end of the pass portion in the apparatus height direction is positioned below the topmost medium on the ejection tray in the apparatus height direction.

10. The image forming system according to claim 8, wherein:

a pass portion is formed between the medium mounting tray and the ejection tray positioned at the second position, the pass portion being configured to enable the medium to pass through the pass portion; and before the controller positions, at the second position, the ejection tray with the medium stacked, the controller stops the ejection tray at a position above the second position so that the medium is positioned above the pass portion.

11. The image forming system according to claim 7, wherein the controller positions the ejection tray at the second position so that a second mounting surface of the medium mounting tray and a first mounting surface of the ejection tray at the second position are aligned in one direction.

12. The image forming system according to claim 7, further comprising an input section configured to enable the input information to be entered or modified on the input section.

13. The image forming system according to claim 12, further comprising a medium detection section that detects whether the medium is present on at least one of the medium mounting tray and the ejection tray, wherein:

the input section is configured to enable a first length to be entered or modified on the input section as the input information, the first length being a length, in a transport direction, of the medium to be mounted on the medium mounting tray; and when the first length that was modified or was entered in advance on the input section is longer than a second length of the medium mounting tray in the transport direction and the medium detection section detects that the medium is not present, the controller positions the ejection tray at the second position.

14. The image forming system according to claim 13, wherein when the first length is longer than the second length of the medium mounting tray in the transport direction, after there is no more medium on the ejection tray, the controller moves the ejection tray from the second position to the first position.

15. The image forming system according to claim 13, wherein when the first length is longer than the second length of the medium mounting tray in the transport direction, after ejection of the medium is started, the controller positions the ejection tray between the first position and the second position.

16. The image forming system according to claim 12, further comprising a selection section configured to select between a first mode in which the ejection tray is positioned at the second position and a second mode in which the ejection tray is not positioned at the second position, wherein:

the input section is configured to enable a first length to be entered or modified on the input section as the input information, the first length being a length, in a transport direction, of the medium to be mounted on the medium mounting tray; and when the first length that was modified or was entered in advance on the input section is shorter than a second length of the medium mounting tray in the transport direction, the controller controls whether to move the ejection tray, depending on which mode, the first mode or the second mode, was selected on the selection section.

17. The image forming system according to claim 12, wherein:

the input section is configured to enable a first length to be entered or modified on the input section as the input information, the first length being a length, in a transport direction, of the medium to be mounted on the medium mounting tray; and when the first length that was modified or was entered in advance on the input section is shorter than a second length of the medium mounting tray in the transport direction, after the medium was mounted on the medium mounting tray with the ejection tray at the second position, the controller moves the ejection tray from the second position to the first position.

* * * * *